US009224269B2

(12) United States Patent
Zacharakis et al.

(10) Patent No.: US 9,224,269 B2
(45) Date of Patent: Dec. 29, 2015

(54) COMPUTER-IMPLEMENTED METHODS AND COMPUTER SYSTEMS FOR ENABLING PERSONALIZED GAME BETTING AND LOTTERY PLAYING

(71) Applicant: Intralot S.A.—Integrated Lottery Systems and Services, Athens (GR)

(72) Inventors: Ioannis Zacharakis, Athens (GR); Spiros Pachnis, Athens (GR); Nikolaos Mastrogiannis, Athens (GR); Dimitrios Gemitzis, Athens (GR); Alexandros Charos, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 22 days.

(21) Appl. No.: 14/020,248

(22) Filed: Sep. 6, 2013

(65) Prior Publication Data

US 2014/0066182 A1 Mar. 6, 2014

Related U.S. Application Data

(60) Provisional application No. 61/697,561, filed on Sep. 6, 2012.

(51) Int. Cl.
*G07F 17/32* (2006.01)

(52) U.S. Cl.
CPC ..... *G07F 17/3288* (2013.01)

(58) Field of Classification Search
USPC ..... 463/25, 17
See application file for complete search history.

(56) References Cited

U.S. PATENT DOCUMENTS

2003/0157976 A1 8/2003 Simon et al.
2007/0060274 A1* 3/2007 Rowe et al. ..... 463/16
2014/0148238 A1* 5/2014 D'Angelo ..... 463/17

FOREIGN PATENT DOCUMENTS

EP 2 390 827 A1 11/2011

OTHER PUBLICATIONS

International Search Report and Written Opinion from International Patent Appln. No. PCT/IB2013/002687 dated Mar. 19, 2014.

* cited by examiner

*Primary Examiner* — Pierre E Elisca
(74) *Attorney, Agent, or Firm* — Greenberg Traurig, LLP

(57) ABSTRACT

In some embodiments, the instant invention provides for a computer-implemented method, performed by a specifically programmed computer system, that that includes: displaying choices to be selected to define a personalized betting game; receiving selected choices, identifying: i) an event, ii) a plurality of markets, and iii) a plurality of potential outcomes; establishing a personalized data structure representative of data relationships among the selected choices, hereby resulting in a personalized betting game of a user; automatically updating the at least one first personalized data structure based, at least in part, on real-time changes; receiving an entry payment from the user to play the at least one first personalized betting game; determining an actual outcome of the personalized betting game; and determining a reward to be distributed to the user.

23 Claims, 23 Drawing Sheets

Area A
Code: 103
Outcome: Final 2

Area B
Code: 1010
Outcome: 1st Half X

Area A
C: 4103
O: 2nd Half 2

Area B
C: 1010
O: Final 1X (double chance)

Area A
C: 2103
O: 1st Half X2 (double chance)
Area B
C: 1010
O: Final Under 2,5

Area A

C: 103

O: Final Away Team Total Goals 1

Area B

C: 110

O: Final Home Under 3,5

Area A

C: 103

O: Final Odd

Area B

C: 110

O: Final Home Team Over 0,5

COMPUTER-IMPLEMENTED METHODS AND COMPUTER SYSTEMS FOR ENABLING PERSONALIZED GAME BETTING AND LOTTERY PLAYING

RELATED APPLICATIONS

This application claims the priority of U.S. provisional application Ser. No. 61/697,561, entitled "MACHINE-READABLE FORM CONFIGURATION AND SYSTEM AND METHOD FOR BETTING," filed Sep. 6, 2012, which is incorporated herein by reference in its entirety for all purposes.

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

TECHNICAL FIELD

In some embodiments, the instant invention is related to computer-implemented methods and computer systems for enabling personalized game betting and lottery playing.

BACKGROUND OF INVENTION

Generally, the popularity of gaming and/or lottery terminals, such as lottery waging machines, slot machines, video poker machines, and the like such terminals among players can depend on the perceived likelihood of winning money at the terminal and the intrinsic entertainment value of the terminal relative to other available options. Where the available options include a number of competing terminals and the expectation of winning each terminal is roughly the same (or believed to be the same), typically, players are most likely to be attracted to the more entertaining and exciting of the terminals.

BRIEF SUMMARY OF INVENTION

In some embodiments, the instant invention provides for a computer-implemented method that that includes at least the following steps of: displaying, by a specifically programmed computer system, to a user, choices to be selected to define at least one first personalized betting game, where the choices are selected from each of the following three categories: i) events, ii) markets, and iii) potential outcomes; receiving, by the specifically programmed computer system, from the user, selected choices, identifying: i) at least one first event, ii) a plurality of markets, and iii) a plurality of potential outcomes; establishing, by the specifically programmed computer system, at least one first personalized data structure representative of data relationships among the selected choices, hereby resulting in at least one first personalized betting game of the user; automatically updating, by the specifically programmed computer system, the at least one first personalized data structure based, at least in part, on real-time changes related to: i) the at least one first event, ii) the plurality of markets, and iii) the plurality of potential outcomes; receiving, by the specifically programmed computer system, an entry payment from the user to play the at least one first personalized betting game; determining, by the specifically programmed computer system, at least one actual outcome of the at least one first personalized betting game; and determining, by the specifically programmed computer system, at least one reward to be distributed to the user.

In some embodiments, the user is a lottery player. In some embodiments, the user is an organizer of the betting game. In some embodiments, the at least one first personalized betting game is a personalized lottery. In some embodiments, the choices to be selected by the user are displayed based, at least in part, on one of the following: i) a geographic location of the user, and ii) a channel used by the user to access the specifically programmed computer system.

In some embodiments, the method can further include automatically updating, by the specifically programmed computer system, the choices to be selected by the user. In some embodiments, the method can further include automatically completing, by the specifically programmed computer system, the at least one first personalized betting game for playing, by incorporating playing options into the at least one first personalized betting game based, at least in part, on the selected choices.

In some embodiments, the playing options are selected based, at least in part, at least one pre-determined template for the betting game. In some embodiments, the at least one predetermined template defines at least the following playing options selected from the group of: i) an event selection, ii) an instant information update, iii) a loyalty scheme, iv) a risk management analysis, and v) a responsible gaming parameterization.

In some embodiments, the at least one first personalized betting game is configured to be identically played at a physical lottery establishment and remotely through at least one computing device. In some embodiments, the at least one computing device is a mobile personal computing device.

In some embodiments, the least one first personalized betting game is configured to be played by a group of member players solicited by or on behalf of the user.

In some embodiments, the least one first even is selected from the group of: i) a soccer game; ii) a basketball game; and iii) a tennis game.

In some embodiments, the instant invention provides for a computer-implemented system that includes at least the following components/modules: at least one specialize computer machine that at least includes: a non-transient memory having at least one region for storing particular computer executable program code; and at least one processor for executing the particular program code stored in the memory, where the particular program code is configured to at least perform the following operations: displaying, to a user, choices to be selected to define at least one first personalized betting game, where the choices are selected from each of the following three categories: i) events, ii) markets, and iii) potential outcomes; receiving, by the specifically programmed computer system, from the user, selected choices, identifying: i) at least one first event, ii) a plurality of markets, and iii) a plurality of potential outcomes; establishing at least one first personalized data structure representative of data relationships among the selected choices, hereby resulting in at least one first personalized betting game of the user; automatically updating the at least one first personalized data structure based, at least in part, on real-time changes related to: i) the at least one first event, ii) the plurality of markets, and iii) the plurality of potential outcomes; receiving an entry payment from the user to play the at least one first personalized betting game; determining at least one actual outcome of the at least one first personalized betting game; and determining at least one reward to be distributed to the user.

BRIEF DESCRIPTION OF THE FIGURES

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

Figure 1:
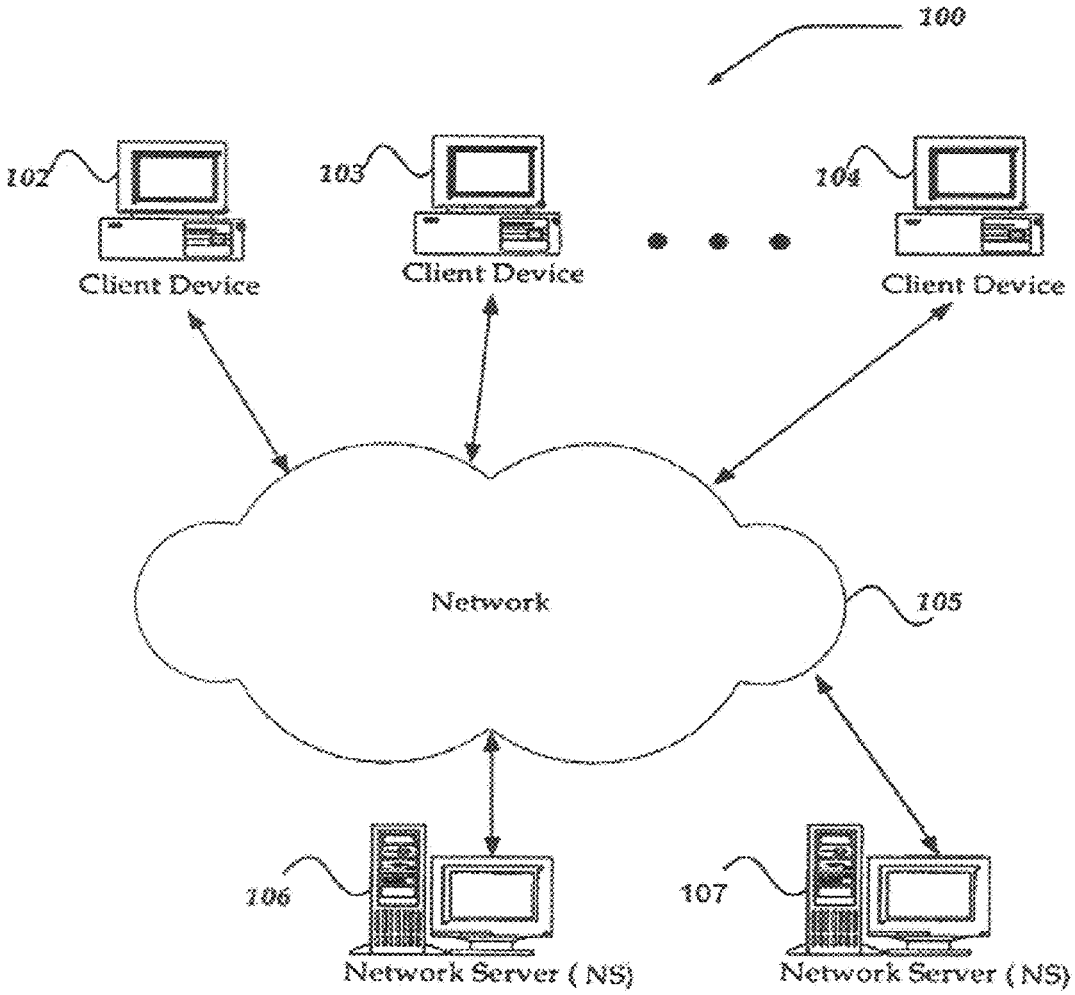
FIG. 1 illustrates an illustrative example in accordance with some embodiments of the present invention.

In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

DETAILED DESCRIPTION OF INVENTION

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive. Any alterations and further modifications of the inventive feature illustrated herein, and any additional applications of the principles of the invention as illustrated herein, which would normally occur to one skilled in the relevant art and having possession of this disclosure, are to be considered within the scope of the invention.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Illustrative Operating Environments

FIG. 1 illustrates one embodiment of an environment in which the present invention may operate. However, not all of these components may be required to practice the invention, and variations in the arrangement and type of the components may be made without departing from the spirit or scope of the invention. In some embodiments, the inventive system and method may include a large number of members and/or concurrent transactions. In other embodiments, the inventive system and method are based on a scalable computer and network architecture that incorporates varies strategies for assessing the data, caching, searching, and database connection pooling. An example of the scalable architecture is an architecture that is capable of operating multiple servers.

In embodiments, members of the inventive computer system 102-104 (e.g. vending machines) include virtually any computing device capable of receiving and sending a message over a network, such as network 105, to and from another computing device, such as servers 106 and 107, each other, and the like. In embodiments, the set of such devices includes devices that typically connect using a wired communications medium such as personal computers, multiprocessor systems, microprocessor-based or programmable consumer electronics, network PCs, and the like. In embodiments, the set of such devices also includes devices that typically connect using a wireless communications medium such as cell phones, smart phones, pagers, walkie talkies, radio frequency (RF) devices, infrared (IR) devices, CBs, integrated devices combining one or more of the preceding devices, or virtually any mobile device, and the like. Similarly, in embodiments, client devices 102-104 are any device that is capable of connecting using a wired or wireless communication medium such as a PDA, POCKET PC, wearable computer, and any other device that is equipped to communicate over a wired and/or wireless communication medium.

In embodiments, each member device within member devices 102-104 may include a browser application that is configured to receive and to send web pages, and the like. In embodiments, the browser application may be configured to receive and display graphics, text, multimedia, and the like, employing virtually any web based language, including, but not limited to Standard Generalized Markup Language (SMGL), such as HyperText Markup Language (HTML), a wireless application protocol (WAP), a Handheld Device Markup Language (HDML), such as Wireless Markup Language (WML), WMLScript, XML, JavaScript, and the like. In embodiments, the invention is programmed in either Java, .Net, QT, C, C++ or other suitable programming language.

In embodiments, member devices 102-104 may be further configured to receive a message from another computing device employing another mechanism, including, but not limited to email, Short Message Service (SMS), Multimedia Message Service (MMS), instant messaging (IM), internet relay chat (IRC), mIRC, Jabber, and the like or a Proprietary protocol.

In embodiments, network 105 may be configured to couple one computing device to another computing device to enable them to communicate. In some embodiments, network 105 may be enabled to employ any form of computer readable media for communicating information from one electronic device to another. Also, in embodiments, network 105 may include a wireless interface, and/or a wired interface, such as the Internet, in addition to local area networks (LANs), wide area networks (WANs), direct connections, such as through a universal serial bus (USB) port, other forms of computer-readable media, or any combination thereof. In embodiments, on an interconnected set of LANs, including those based on differing architectures and protocols, a router may act as a link between LANs, enabling messages to be sent from one to another.

Also, in some embodiments, communication links within LANs typically include twisted wire pair or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links including satellite links, or other communications links known to those skilled in the art. Furthermore, in some embodiments, remote computers and other related electronic devices could be remotely connected to either LANs or WANs via a modem and temporary telephone link. In essence, in some embodiments, network 105 includes any communication method by which information may travel between client devices 102-104, and servers 106 and 107.

Figure 2:
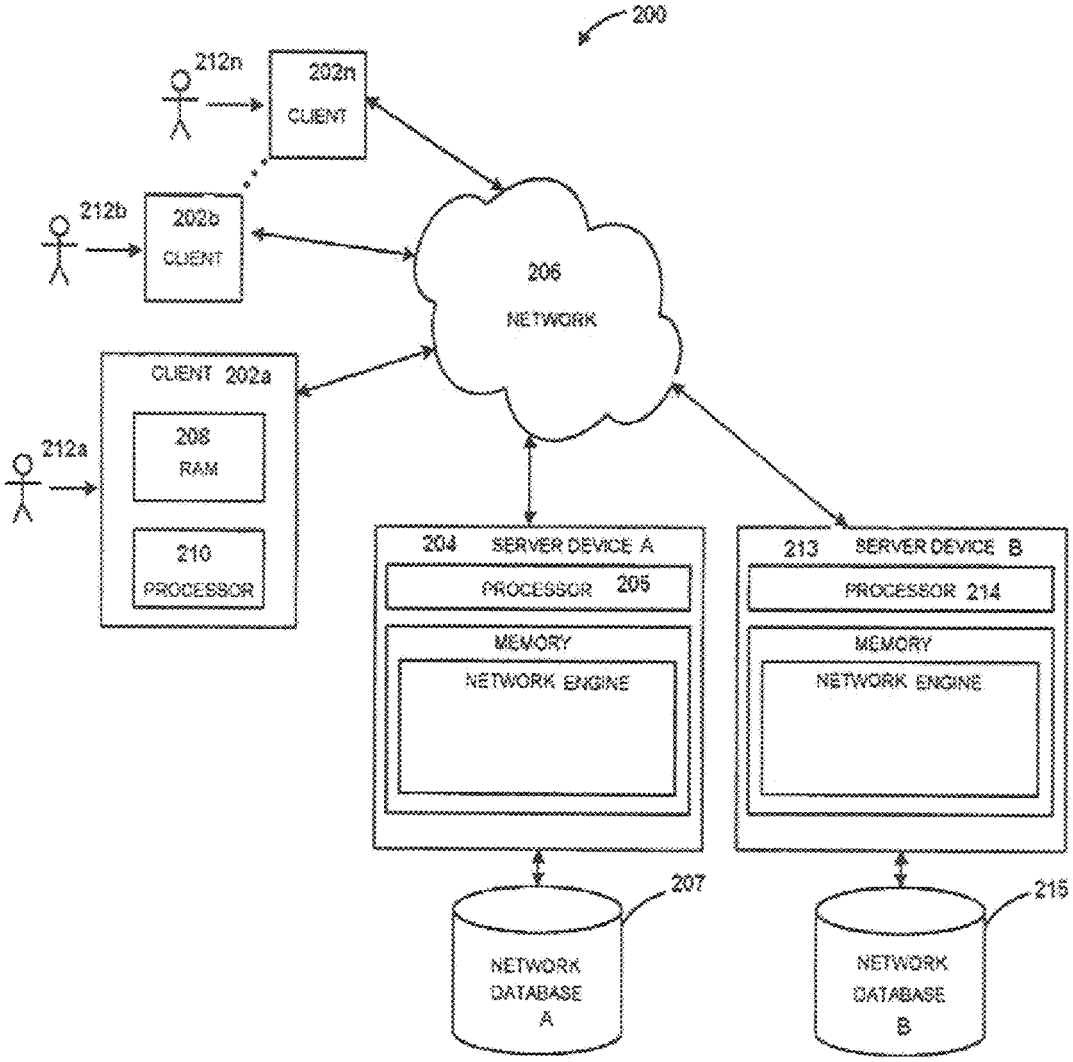
FIG. 2 illustrates another illustrative example in accordance with some embodiments of the present invention.

FIG. 2 shows another exemplary embodiment of the computer and network architecture that supports the inventive method and system. The member devices 202*a*, 202*b* thru 202*n* shown (e.g., vending machines) each at least includes a computer-readable medium, such as a random access memory (RAM) 208 coupled to a processor 210 or FLASH memory. The processor 210 may execute computer-executable program instructions stored in memory 208. Such processors comprise a microprocessor, an ASIC, and state machines. Such processors comprise, or may be in communication with, media, for example computer-readable media, which stores instructions that, when executed by the processor, cause the processor to perform the steps described herein. Embodiments of computer-readable media may include, but are not limited to, an electronic, optical, magnetic, or other storage or transmission device capable of providing a processor, such as the processor 210 of client 202*a*, with computer-readable instructions. Other examples of suitable media may include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media may transmit or carry instructions to a computer, including a router, private or public network, or other transmission device or channel, both wired and wireless. The instructions may comprise code from any computer-programming language, including, for example, C, C++, C#, Visual Basic, Java, Python, Perl, and JavaScript Member devices 202*a-n* may also comprise a number of external or internal devices such as a mouse, a CD-ROM, DVD, a keyboard, a display, or other input or output devices. Examples of client devices 202*a-n* may be personal computers, digital assistants, personal digital assistants, cellular phones, mobile phones, smart phones, pagers, digital tablets, laptop computers, Internet appliances, and other processor-based devices. In general, a client device 202*a* are be any type of processor-based platform that is connected to a network 206 and that interacts with one or more application programs. Client devices 202*a-n* may operate on any operating system capable of supporting a browser or browser-enabled application, such as Microsoft™, Windows™, or Linux. The client devices 202*a-n* shown may include, for example, personal computers executing a browser application program such as Microsoft Corporation's Internet Explorer™, Apple Computer, Inc.'s Safari™, Mozilla Firefox, and Opera. Through the client devices 202*a-n*, users (e.g. players, agents, etc.) 212*a-n* communicate over the network 206 with each other and with other systems and devices coupled to the network 206. As shown in FIG. 2, server devices 204 and 213 may be also coupled to the network 206.

In some embodiments, the term "mobile electronic device" may refer to any portable electronic device that may or may not be enabled with location tracking functionality. For example, a mobile electronic device can include, but is not limited to, a mobile phone, Personal Digital Assistant (PDA), Blackberry™, Pager, Smartphone, or any other reasonable mobile electronic device. For ease, at times the above variations are not listed or are only partially listed, this is in no way meant to be a limitation.

In some embodiments, the terms "proximity detection," "locating," "location data," "location information," and "location tracking" as used herein may refer to any form of location tracking technology or locating method that can be used to provide a location of a mobile electronic device, such as, but not limited to, at least one of location information manually input by a user, such as, but not limited to entering the city, town, municipality, zip code, area code, cross streets, or by any other reasonable entry to determine a geographical area; Global Positions Systems (GPS); GPS accessed using Bluetooth™; GPS accessed using any reasonable form of wireless and/or non-wireless communication; WiFi™ server location data; Bluetooth™ based location data; triangulation such as, but not limited to, network based triangulation, WiFi™ server information based triangulation, Bluetooth™ server information based triangulation; Cell Identification based triangulation, Enhanced Cell Identification based triangulation, Uplink-Time difference of arrival (U-TDOA) based triangulation, Time of arrival (TOA) based triangulation, Angle of arrival (AOA) based triangulation; techniques and systems using a geographic coordinate system such as, but not limited to, longitudinal and latitudinal based, geodesic height based, cartesian coordinates based; Radio Frequency Identification such as, but not limited to, Long range RFID, Short range RFID; using any form of RFID tag such as, but not limited to active RFID tags, passive RFID tags, battery assisted passive RFID tags; or any other reasonable way to determine location. For ease, at times the above variations are not listed or are only partially listed, this is in no way meant to be a limitation.

In some embodiments, near-field wireless communication (NFC) can represent a short-range wireless communications technology in which NFC-enabled devices are "swiped," "bumped," "tap" or otherwise moved in close proximity to communicate. In some embodiments, NFC could include a set of short-range wireless technologies, typically requiring a distance of 10 cm or less.

In some embodiments, NFC may operate at 13.56 MHz on ISO/IEC 18000-3 air interface and at rates ranging from 106 kbit/s to 424 kbit/s. In some embodiments, NFC can involve an initiator and a target; the initiator actively generates an RF field that can power a passive target. In some embodiment, this can enable NFC targets to take very simple form factors such as tags, stickers, key fobs, or cards that do not require batteries. In some embodiments, NFC peer-to-peer communication can be conducted when a plurality of NFC-enable devices within close proximity of each other.

Illustrative Examples of the Present Invention

An embodiment of the present invention relates to a system and method for betting using one or more computers.

One embodiment of the present invention relates to a machine-readable form configuration (and associated system and method) that may be a play slip for betting.

In some embodiments, the present invention is a system for betting that includes a computer and receives external information including, but not limited to, sports book information, events, odds, and/or results. In some embodiments, the system includes sports book management that may include, but is not limited to, event, template, and/or odds compiling, results handling, and/or update handling. In some embodiments, the system includes risk management, that may include, but is not limited to, real time monitoring, bet analysis, stake & liability management, high stake negotiations, locks, restrictions and relations, management, alerts, live betting, liability estimator, high risk combinations, event, market, outcome management, and/or channel management. In some embodiments, the system includes a game engine that may include, but is not limited to, transaction processing, risk preventive management, game processing, and/or results & winner management. In some embodiments, the system that includes content display management, that may include, but is not limited to, Internet (e.g., B-On), retail monitors (e.g., LOTOS® Horizon), teletext, and/or external feeds.

Figure 3:
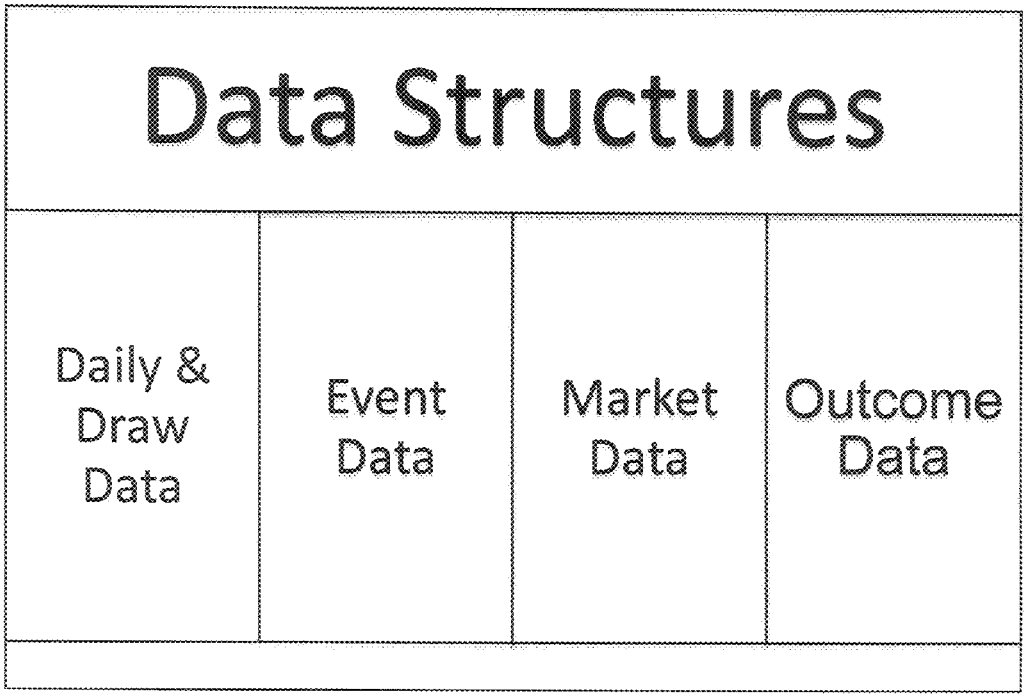
FIG. 3 illustrates an exemplary data structure in accordance with some embodiments of the present invention.
Figure 4:
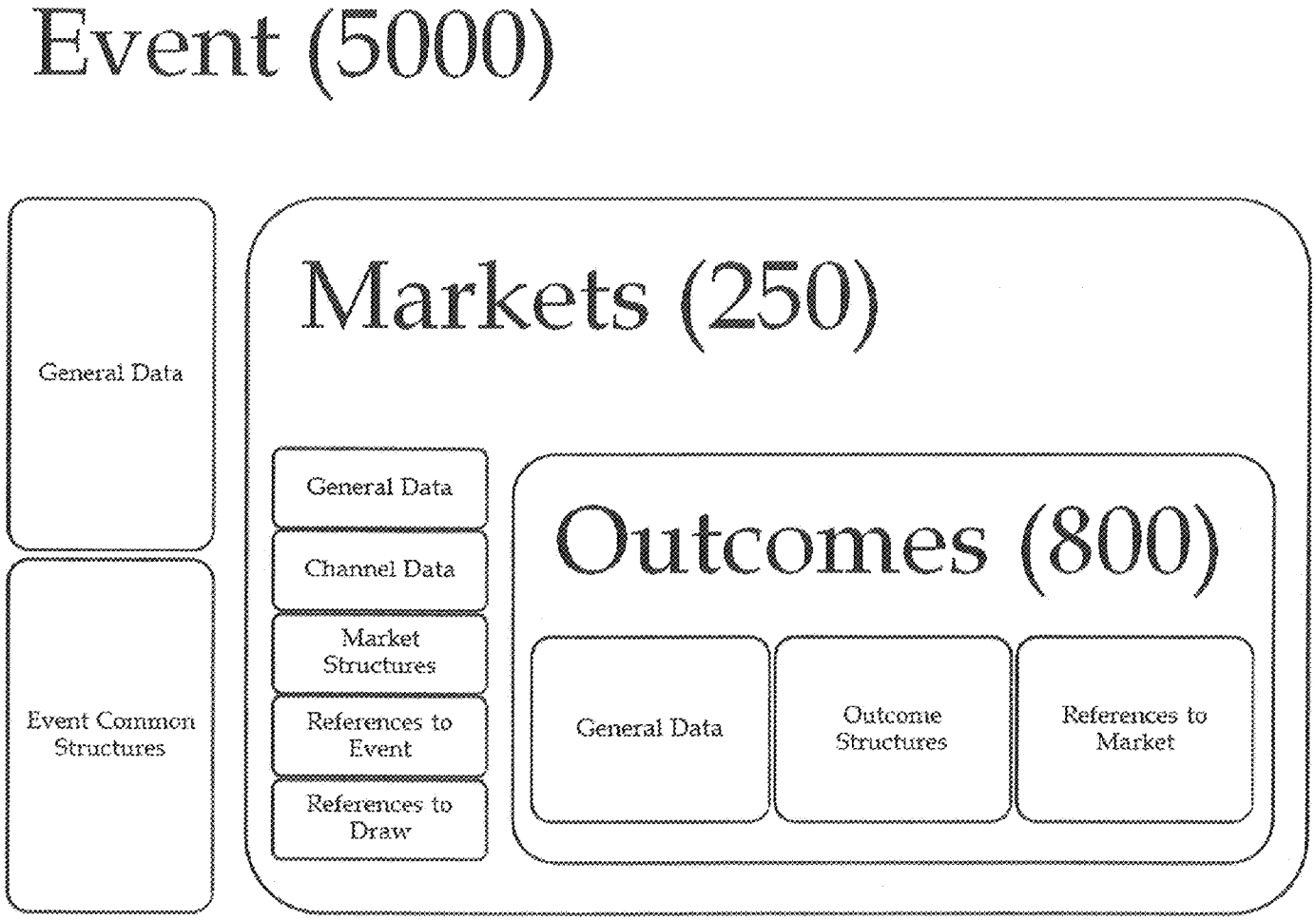
FIG. 4 illustrates another exemplary data structure in accordance with some embodiments of the present invention.

In some embodiments, the system includes multiple data structures stored on a computer. In some embodiments, the data structures include, but are not limited to, daily & draw data, event data, market data, and outcome data as shown in FIG. 3.

In some embodiments, the daily & draw data structures include, but is not limited to, the data structures, utilized as detailed below:

- General Data
- Display Data Revision (Normal & Live Events)
- Payout Method
- Not Operational Hours Risk Factor
  - 2 Time Frames (From-To)
  - Risk Level adjustment during non operational hours (0-255%)
  - Negotiation→Rejection
- Column Liability Limits (4-7+ length)
- Combination Risk Levels (10 groups)
- Score-cast coefficients (3 factors)
- Stake & Liability Risk Type Limits (50 instances)
- 5 risk levels for 1-3 columns
- Lower/Upper Outcome Odd Limit
- Column Stake Limit (>Negotiation)
- Column Liability Limit (>Negotiation)
- Combination Locks and Relations
- Outcome locking combinations (1000 instances)
  - Status
  - Method (All lengths, above X length, below X length)
  - Combination Risk (>level→Negotiation)
  - Lock Size (2-4)
  - Event/Outcome Selection (2-4)
- Event locking combinations (1000 instances)
  - Status (Event, Event/Market, Event/Outcome pairs)
  - Method (All lengths, above X length, below X length)
  - Combination Risk (>level→Negotiation)
  - Channel Action (All or specific)
  - Event, Market, Outcome Selection (1 pair)
- Mutual Exclusive combinations (1000 instances)
  - Status
  - Event Type, Event Selection (1 pair)
- Bonus & Happy Hours Odds Schemas (3 Instances)
- Start & End time of bonus
- Lower Outcome Odds limit
- Lower Combination Odds limit
- Bonus (20 lengths)
  - Bonus per combination Length
  - 0%-255%
- Odd Per Combination Length (3 Instances)
- Odds per combination length
- Maximum for 20 combination lengths.

Further, in some embodiments, instant invention allows numerous combinations/permutations grouping based on data structures associated with the event data (5,000 events), market data (250 markets), and outcome data (800 outcomes) including, but is not limited to, the nested data structures incorporating various permutations as shown on FIG. 5 and as detailed below:

- Event Data (e.g., 5000 Instances)
- Method (e.h., Antepost, Rolling, etc.)
- Status
- Event ID (System ID)
- Event Type (Sporting, Non-Sporting Type)
- Country (0 . . . 255)
- Competition (0 . . . 255)
- Date and Time Variables (100 instances)
- Event Normal Index Market (e.g., 5 instances)
  - Current Active position/index (0 . . . 19)
  - Outcomes ID (e.g., 3 instances)
  - Results per index and outcome (20 instances×3 outcomes)
- Event Special Index Market (e.g., 2 instances)
  - Current Active position/index (0 . . . 9)
  - Outcomes ID (e.g., 50 instances)
  - Results per index and outcome (e.g., 10 instances×50 outcomes)
- Event Results (e.g., 14 instances)
- Event Channel Data (e.g., 5 Channels)
- Status
- Participation Delay (seconds)
- Odds set (0,1,2)
- Event Channel Restriction Group (e.g., 2 Instances Per Channel)
- Pay Limit (Maximum payout limit)
- Play Limit (Normal)
- Play Limit (Live)
- Event Market Data (e.g., 250 Instances)

Status
Event Channel Restriction Group IDX/EVENT (0,1)
Stake & liability Risk Type Limits IDX/DRAW (0 . . . 49)
Risk type Factor (0 . . . 255%)
Restriction & Relations (e.g., 5 instances)
  Type
  Minimum, Maximum, Total Maximum
  Relation (None, Bachelor, Minimum Required, Scorecast)
Expected & Actual Winners
Variable Market Data
  Method (None, 1 value [Under/Over, Handicap], 2 values [Handicap Range])
  Values (1 . . . 2)
Indexed Market Data
  Method (None, Normal, Special)
  Event Index Market Index (IDX) (0 . . . 4: Normal, 0 . . . 1: Special)
Market Channel Data (e.g., 5 instances)
  Method (e.g., Live Status, Odds Method to use or odds per combination length set, Bonus Participation, etc.)
  Date IDX/EVENT
  Market District—Allowed districts (e.g., 16 instances)
Event Outcomes (e.g., 800 Instances)
Status
Event Market IDX/EVENT
Outcome Odds Change (per set)
Odds Set (e.g., 3 instances).

Figure 5:
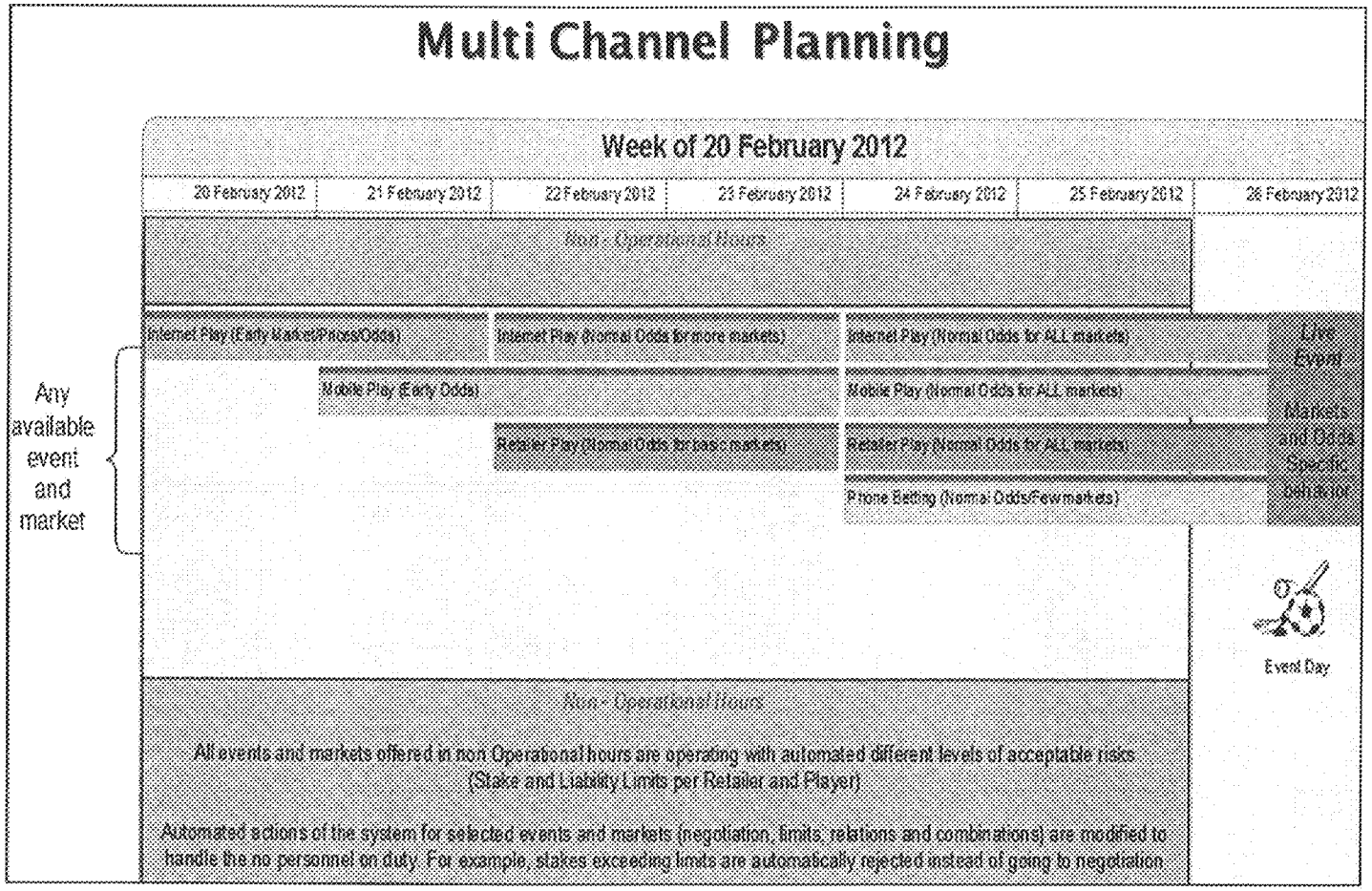
FIG. 5 illustrates an example in accordance with some embodiments of the present invention.

In some embodiments, the system includes planning associated with the multi-channel integration, as for example identified in FIG. 5. In some embodiments, the system includes trading procedures and actions based on one or more template. In some embodiments, these procedures and/or actions include, but are not limited to, automatic handling of new events, automated procedures for result manipulation and updates, automated feeds (external or internal) for odds and results, and/or odds calculation based on algorithms (e.g., black box and/or operator defined). In other embodiments, the system includes support of live betting that includes, but is not limited to, one by one handling of live events, instant changes and instant recalculation of new odds and results, new markets specific for live bets, markets that can start as pre-game markets and evolve as live markets, live feeds handling from different vendors, odds and results, and/or specific real time reports and current liability stand. In an embodiment, the system includes personalized live betting trading screens that may include, but are not limited to, select 3 events to "watch" in parallel", select 4 live events that user supervises, etc.

Figure 6:
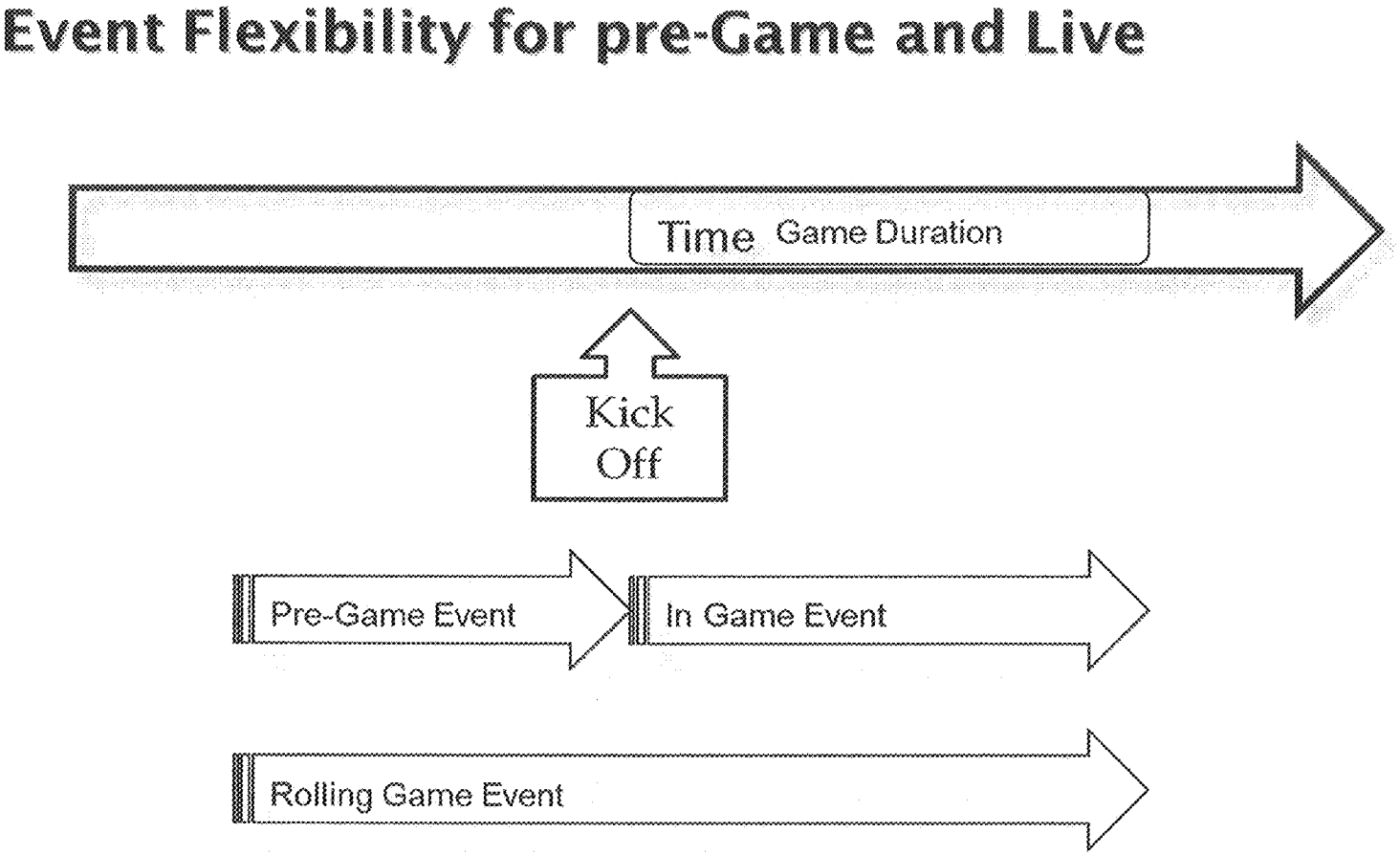
FIG. 6 illustrates another example in accordance with some embodiments of the present invention.

Another embodiment is shown on FIG. 6. In the embodiment, the system allows for flexibility for pre-game, in-game (live), or rolling game events.

In some embodiments, the system may include multichannel integration, a plurality of games, personalization of visual display of winning results, and/or automatic update of play options that may include, but are not limited to event selection, instant information revision, loyalty schemes deployment, risk management, and/or responsible gaming parameterization.

In some embodiments, the system allows multi-channel integration of games. In some embodiments, the system allows a different set of offered bets across different channels and different regions. In some embodiments, the system allows players to form multiple bets by grouping the desired event outcomes using various options. In some embodiments, the is centrally automated to dispense playing options that may include, but are not limited to, event selection, instant information update, loyalty schemes deployment, risk management, and/or responsible gaming parameterization.

In some embodiments, the system includes playing options that may be automated. In some embodiments, the automation is based on specifications that may include, but are not limited to, event selection, instant information update, loyalty schemes deployment, risk management, and/or responsible gaming parameterization.

In one embodiment, the method of the present invention will start with a player selecting a channel where the participation (i.e., "bet" or "entry") will be placed. In some embodiments, the channel will include, but is not limited to, retail, internet, mobile, internet television, and/or phone. In some embodiments, the method includes a system of the present invention is designed and integrated across one or more channels. In some embodiments, the method includes a system that allows for anonymous play, named user play, Social media play and options including, but not limited to, Wager, Tournament, Rake, Subscription, and/or Group Play.

In an embodiment, the player selects a betting game including, but not limited to, sporting or non-sporting games. In some embodiments, the player is then presented with and selects options that include, but are not limited to, events, markets for each event type, outcomes for each market, and/or odds to choose from. In some embodiments, up to 5,000 daily events can be selected. In some embodiments, sporting event types include, but are not limited to, football, basketball, baseball, volleyball, tennis, golf, ice hockey, handball, polo, olympics, and/or American football. In some embodiments, non-sporting event types include, but are not limited to, rally/formula, race/car racing, race/horse racing, race/greyhound racing, boxing, snooker, bowling, other (200 . . . 250), election, and/or survey.

In some embodiments, up to 250 markets may be available per event per channel. In some embodiments, the markets include, but are not limited to, markets that are common or specific for certain event types. In some embodiments, the markets include, but are not limited to, Final, Semi-Final, Semi-Finale/Final, 1st, 2nd, 3rd, 4th half, Half with most goals, Handicaps on Finals, Under/Over 0.5, 1.0, . . . xx.xx depending on event type, Under/Over on Final, Half, Specific Half, Home, Away, Total Goals, Goals/Half, Sum of Goals, First/Next Goal, First Team to Score, on which half, etc, Final Correct Score, 1st Half correct score, etc, Draw no bet, Home no bet, Away no bet, and/or Periods Under/Over, Sets, and/or Correct Score on Sets. For example, in some embodiments, numerous markets as disclosed, inter alia, in U.S. patent application Ser. No. 13,935,996, entitled "METHODS AND SYSTEMS FOR CONDUCTING GAMES OF CHANCE" whose specific examples of such markets are incorporated herein by reference in their entirety for all related purposes discussed herein.

In some embodiments, the "outcome" refers to fixed odds betting for a game. In some embodiments, up to 800 outcome selections per event and per channel are available.

In some embodiments, the rules for an event may be different on a per market basis. In some embodiments, the start and end date and/or time per market, event, and/or channel can be different. In an embodiment, a bonus may be awarded and altered per event and/or market. In some embodiments, different combinations of events, events/markets, events/outcomes and/or variations thereof can be locked. In some embodiments, 200 or more templates per event and/or event type are available.

In some embodiments, the playing options are automated upon specifications that may include, but are not limited to, event selection, instant information update, loyalty schemes deployment, risk management, and/or responsible gaming parameterization. In some embodiments, the player then pays for the entry. In some embodiments, the payment may includes, but is not limited to, cash, credit card, eWallets, virtual currencies, and/or loyalty & freemium points.

In some embodiments, after payment, the system runs security check on player and approves/disapproves and registers the entry.

In some embodiments, the player personalizes the visualization of the preferred game winning results. In some embodiments, in the event of a winning result, the system verifies player's eligibility to a prize and approves prize disposal. In some embodiments, the prize may include, but is not limited to, promotional material and/or cash, virtual currency, physical prizes, loyalty points, and/or recommendations.

In some embodiments, the method includes a player that selects a channel to play. In some embodiments, the player chooses play options that may include, but are not limited to, events, outcome selections per event, and/or odds. In some embodiments, the player views winning results based on a personalized display. In some embodiments, the player receives a prize in the case of a winning result. In some embodiments, the player is automatically awarded loyalty schemes.

In some embodiments, the method includes participation from a plurality of channels. In some embodiments, the method may further include personalized visualization of winning and/or losing results. In some embodiments, the automatic loyalty schemes may also be included.

In an embodiment, the method includes multi-channel group play as identified below. In an embodiment, the player chooses the a channel including, but not limited to, retail, internet, mobile, internet television, and/or phone from where the participation is placed. In some embodiments, the games in the system are designed and integrated across channels allowing anonymous play, named user play, Social media play. In some embodiments, the player selects the betting game. In some embodiments, the player next selects game indicia including, but not limited to, numbers, symbols, and/or event result. In some embodiments, the player then decides on Group Play options that may include, but are not limited to, stake, number and value of shares, subscription duration, member number and activation, and/or group name.

In some embodiments of the system, all playing options are automated upon specifications that include, but are not limited to, event selection, instant information update, loyalty schemes deployment, risk management, and/or responsible gaming parameterization. In some embodiments, the player pays for entry using cash, credit card, eWallets, virtual currencies, and/or loyalty & freemium points.

In some embodiments, the system then runs security check on player and approves/registers entry. In some embodiments, the system creates the number of shares of the kind the player has selected, e.g., a $10 entry is divided into 5 shares of $2 each. In some embodiments, the player invites the stated members to form a group that may include 5 members, with the use of Social media, Lottery website, or other acceptable method.

In some embodiments, the player can personalize the visualization of the preferred game winning results. In some embodiments, the players collect winnings in the case of winning result according to the share they have obtained from the entry. In some embodiments, the system verifies players' eligibility to a prize and approves prize disposal. In some embodiments, the players are awarded promotional material that may include, but is not limited to, cash, virtual currency, prizes, loyalty points, and/or recommendations.

Figure 7:
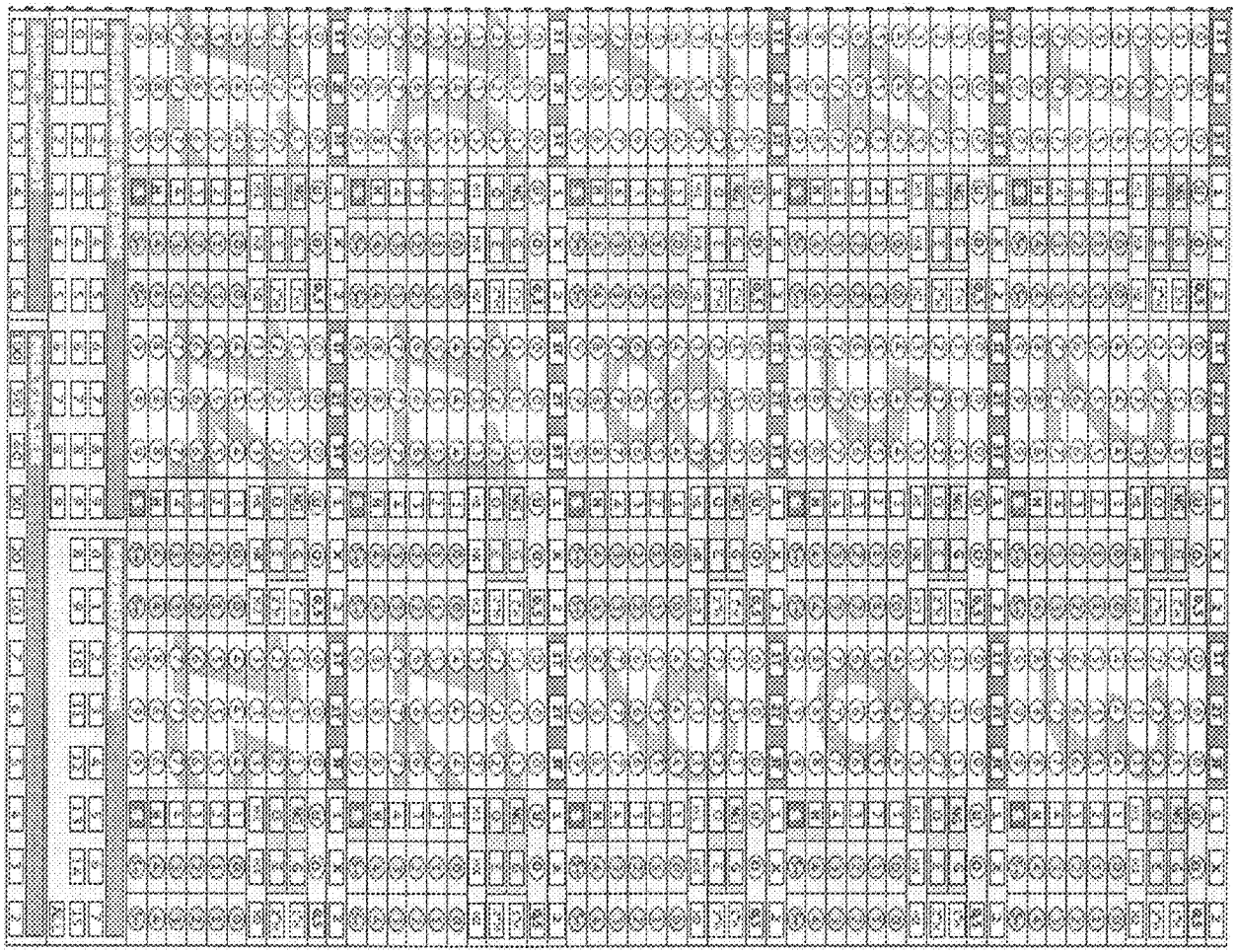
FIG. 7 is a screenshot of a game/lottery slip in accordance with some embodiments of the present invention.
Figure 8:
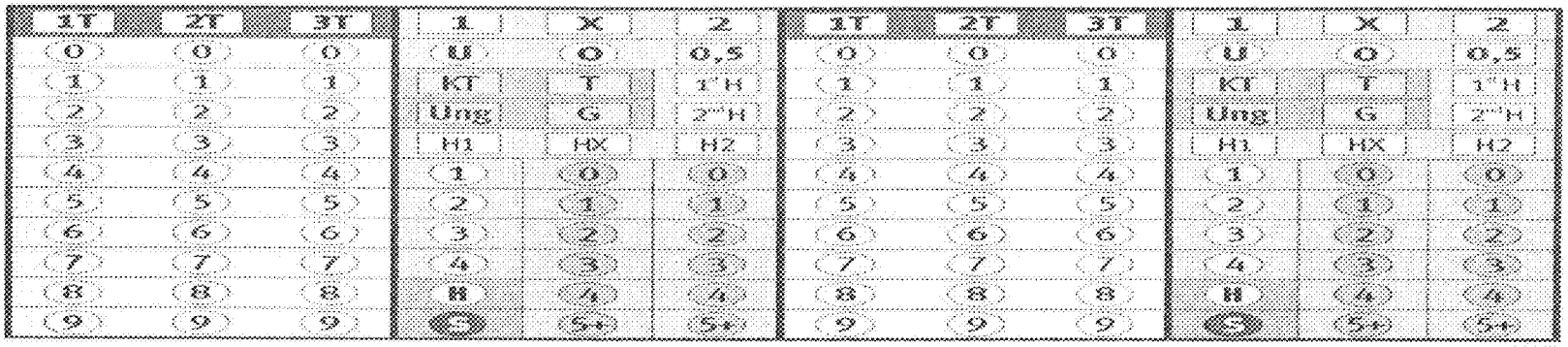
FIG. 8 is a screenshot of another game/lottery slip in accordance with some embodiments of the present invention.

FIG. 7 shows an embodiment of a play slip configuration. FIG. 8 also shows an embodiment of a play slip configuration. In the embodiment, the play slip includes a section for event codes, a prediction area with a standard button, and outright codes.

In some embodiments, the instant invention can be applied to European football (soccer) sporting events with multiple markets and outcomes selected. Below are examples of various potential permutations that can be utilized for soccer events in some embodiments of the instant invention:

Final Result, Double Chance
Half time Result, Double Chance
$2^{nd}$ Half Result, Double Chance
Half time/Full time
Half with most Goals
Final Result with Handicap
U/O Final (0,5-9,5)
U/O $1^{st}$ Half (0,5-5,5)
U/O $2^{nd}$ Half (0,5-5,5)
U/O Home Team Goals (0,5-5,5)
U/O Away Team Goals (0,5-5,5)
Total Goals Final (0, 1, 2, 3, 4, 5+)
Total Goals $1^{st}$ Half (0, 1, 2, 3, 4, 5+)
Total Goals $2^{nd}$ Half (0, 1, 2, 3, 4, 5+)
Total Goals Home Team Final (0, 1, 2, 3, 4, 5+)
Total Goals Away Team Final (0, 1, 2, 3, 4, 5+)
Total Goals Home Team $1^{st}$ Half (0, 1, 2, 3, 4, 5+)
Total Goals Home Team $2^{nd}$ Half (0, 1, 2, 3, 4, 5+)
Total Goals Away Team $1^{st}$ Half (0, 1, 2, 3, 4, 5+)
Total Goals Away Team $2^{nd}$ Half (0, 1, 2, 3, 4, 5+)
Sum of Goals Final (0-1, 2-3, 4+)
Goal/No Goal Final
Goal/No Goal $1^{st}$ Half
Goal/No Goal $2^{nd}$ Half
Odd/Even
Odd/Even Halftime
First Team to score/Next Goal
First Team to score $1^{st}$ Half
First Team to score $2^{nd}$ Half
Correct Score Final
Correct Score $1^{st}$ Half
Draw No Bet
Home No Bet
Away No Bet.

Figure 9A:
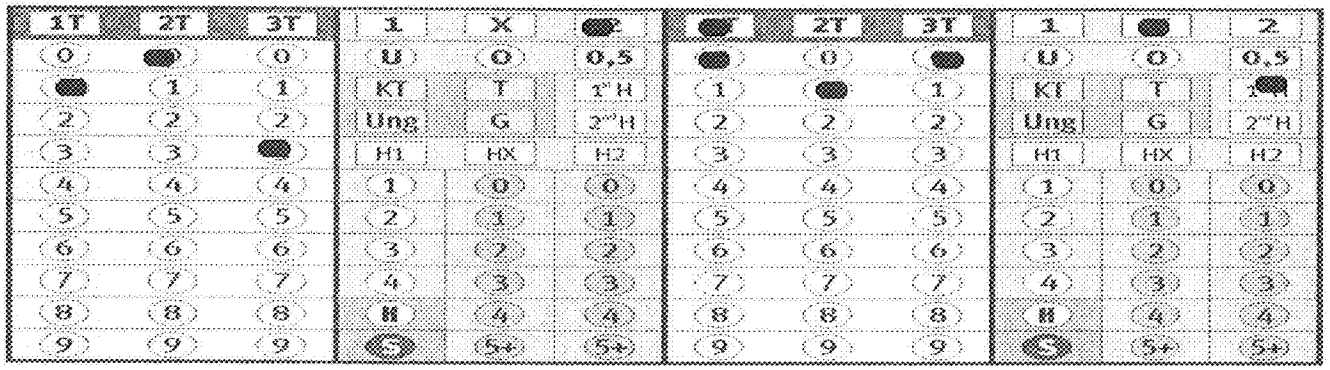
FIGS. 9A-9T are screenshots that illustrate examples of game/lottery slips in accordance with some embodiments of the present invention.
Figure 9B:
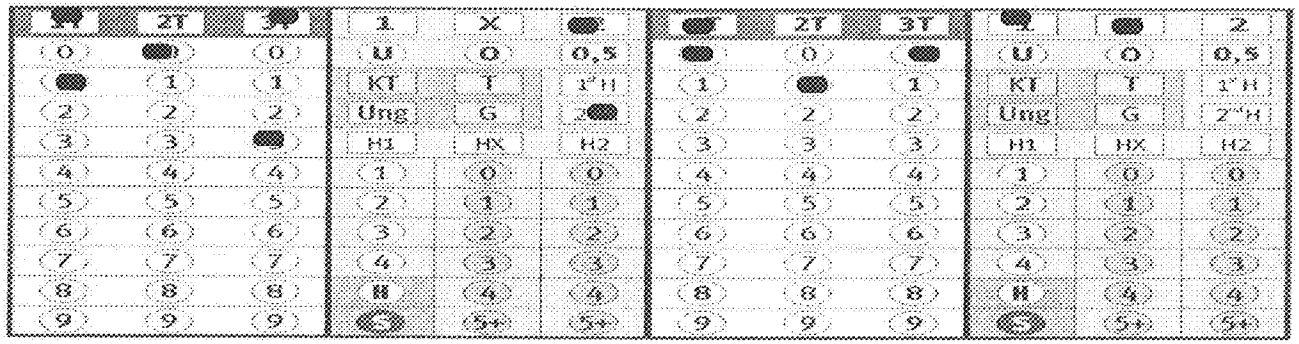
Figure 9C:
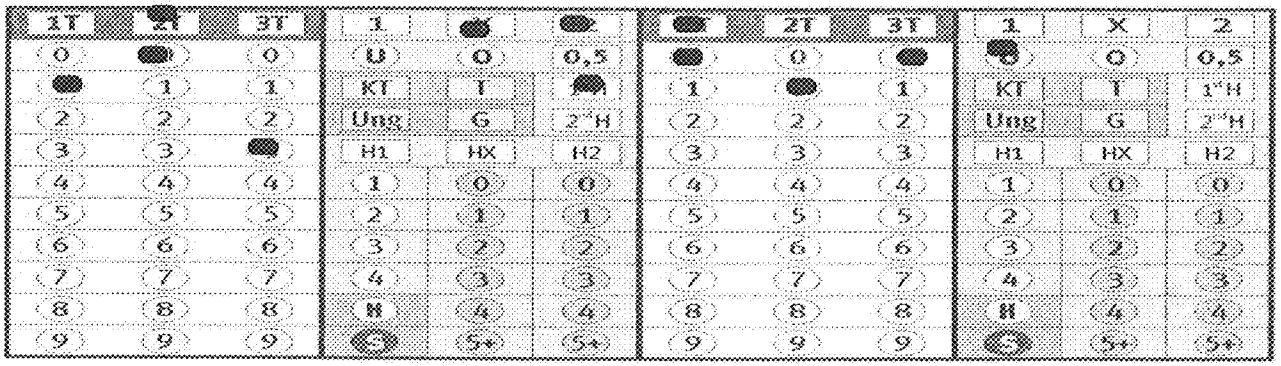
Figure 9D:
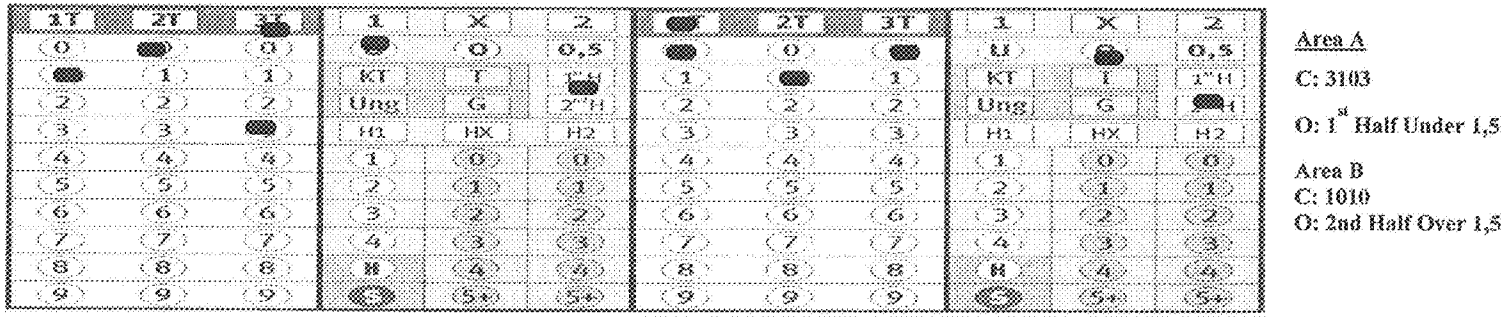
Figure 9E:
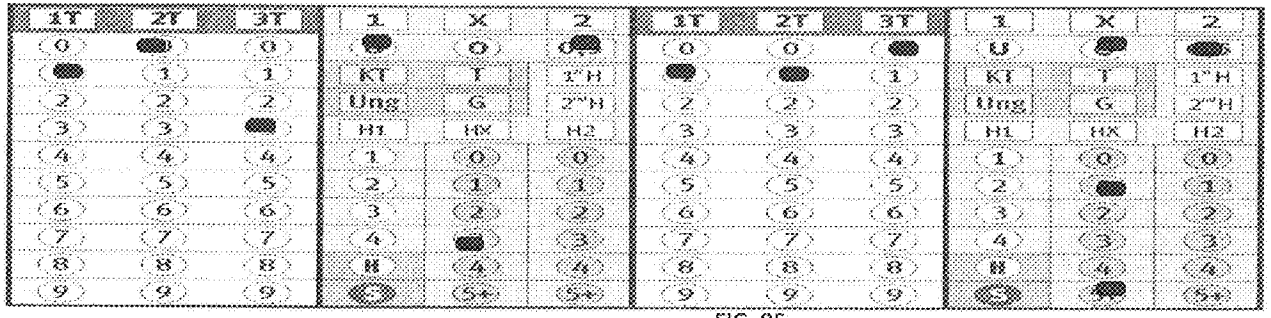
Figure 9F:
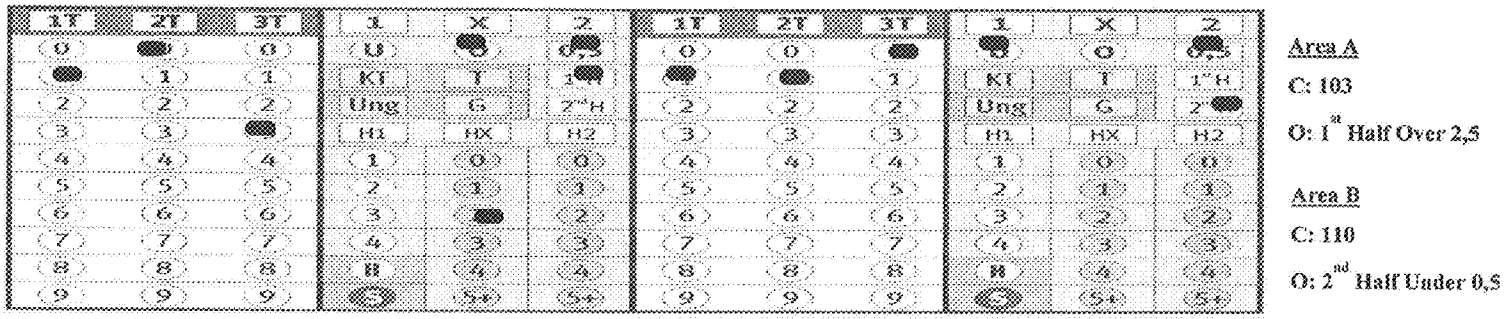
Figure 9G:
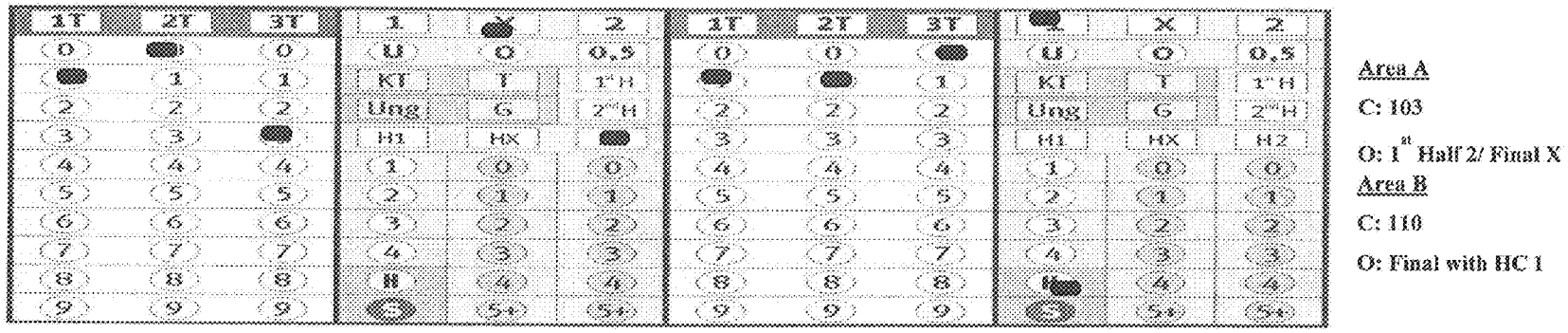
Figure 9H:
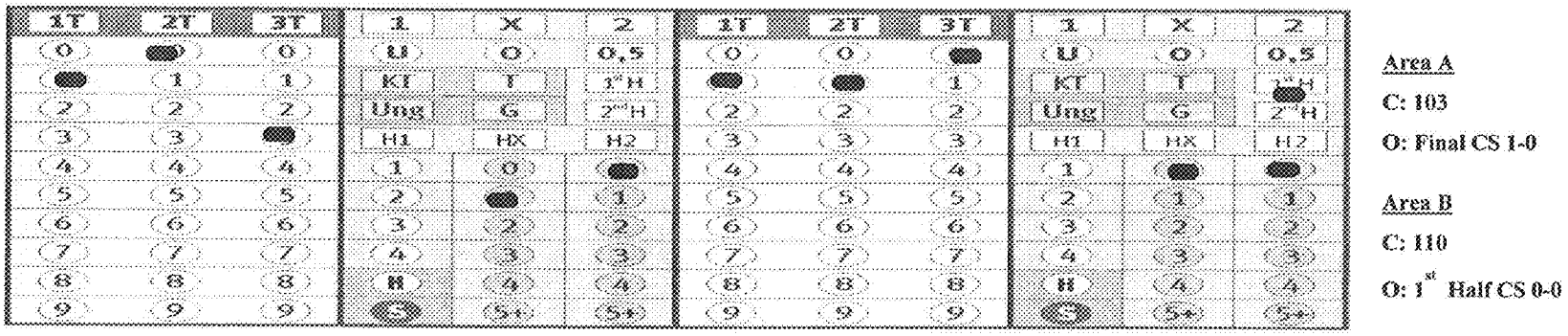
Figure 9I:
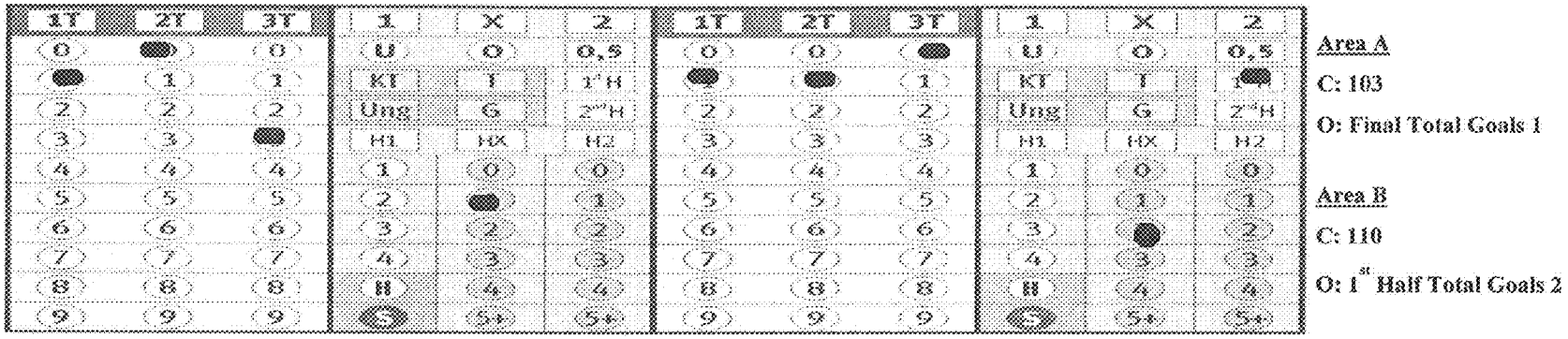
Figure 9J:
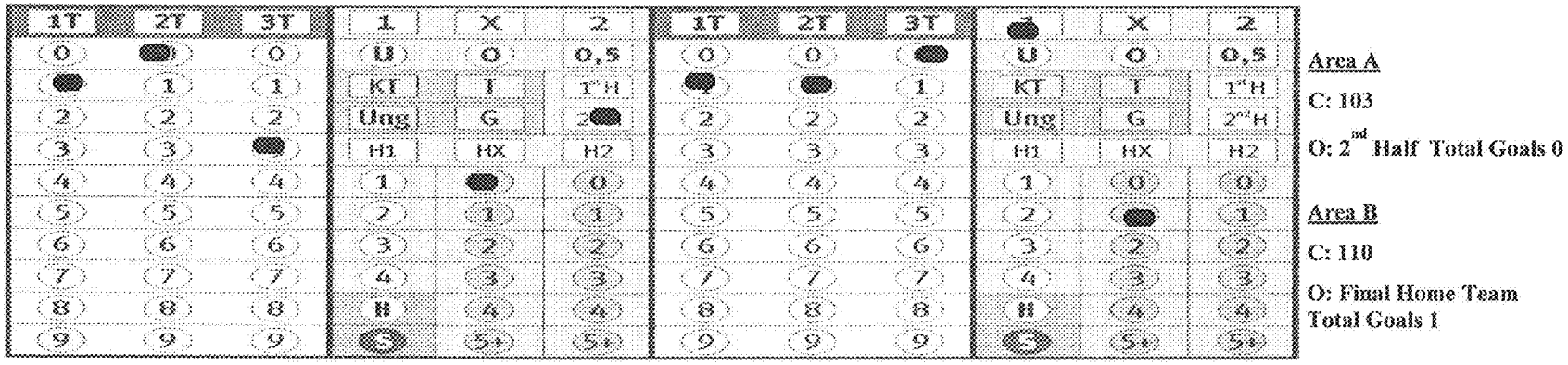
Figure 9K:
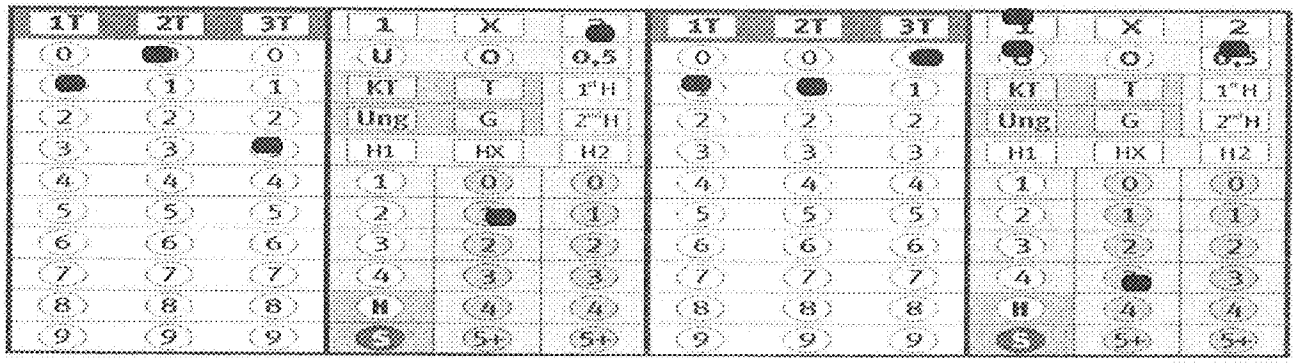
Figure 9L:
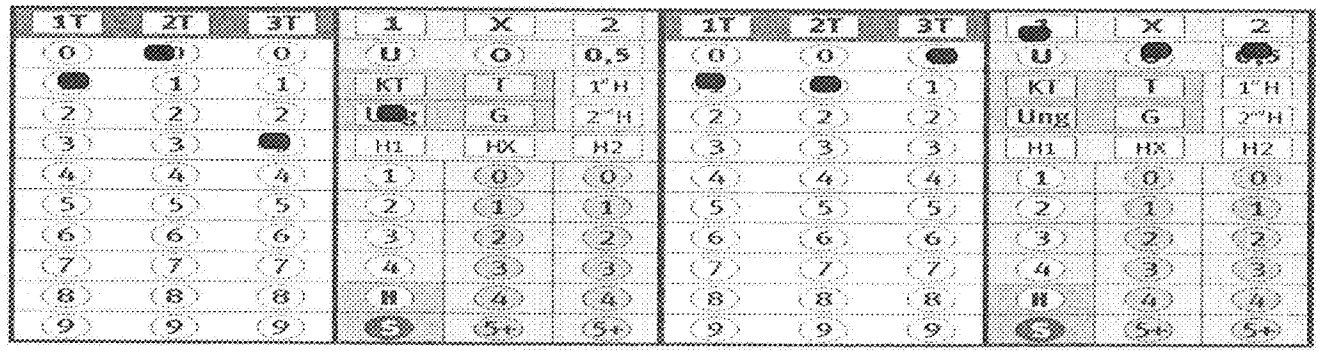
Figure 9M:
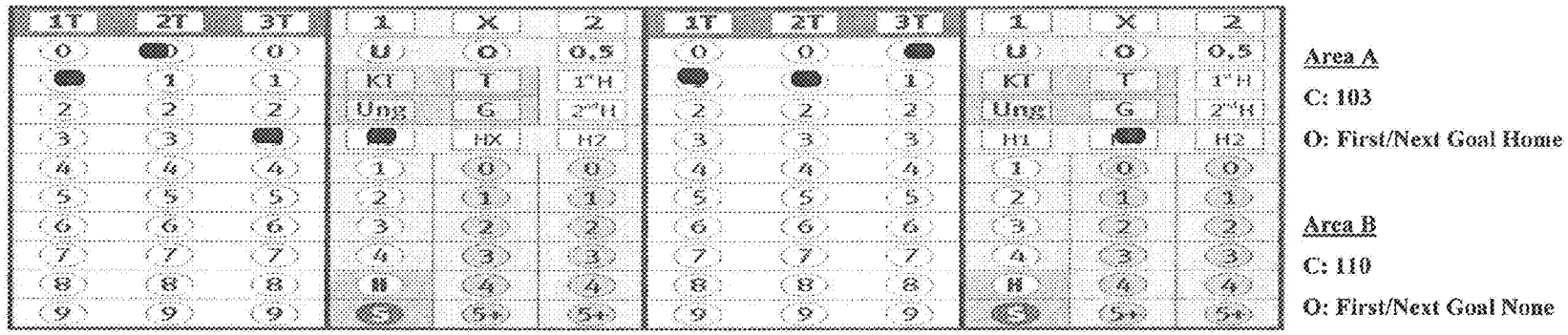
Figure 9N:
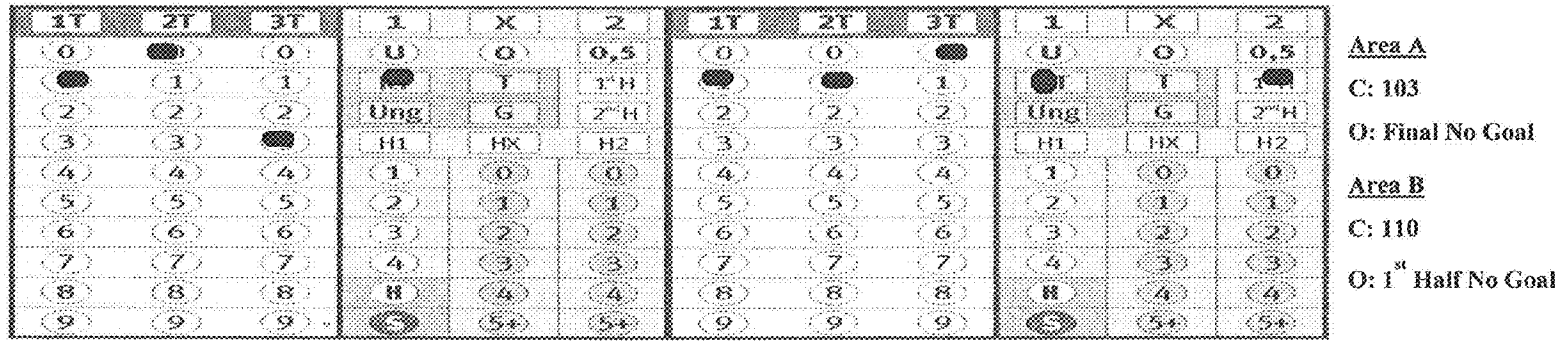
Figure 9O:
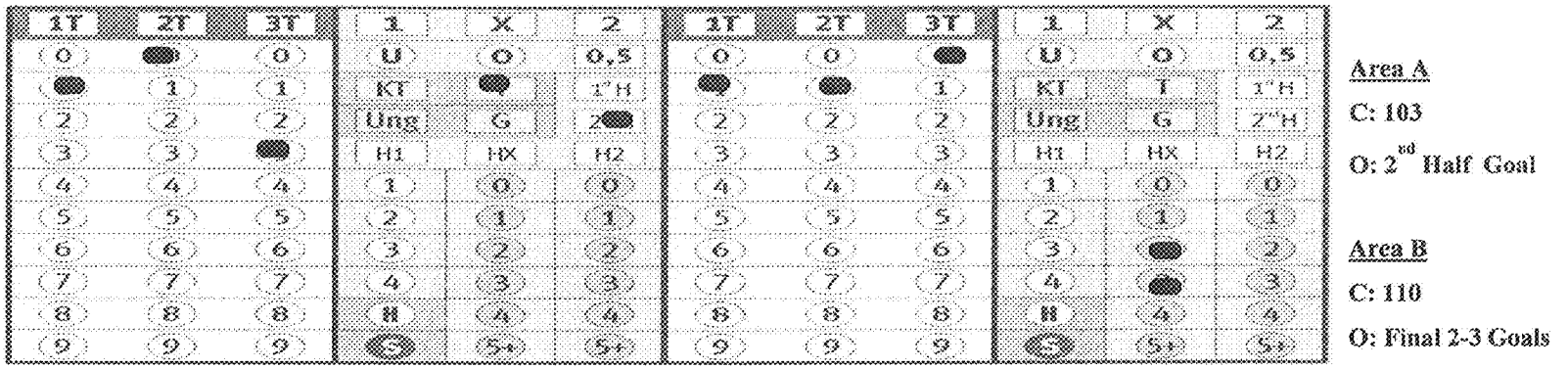
Figure 9P:
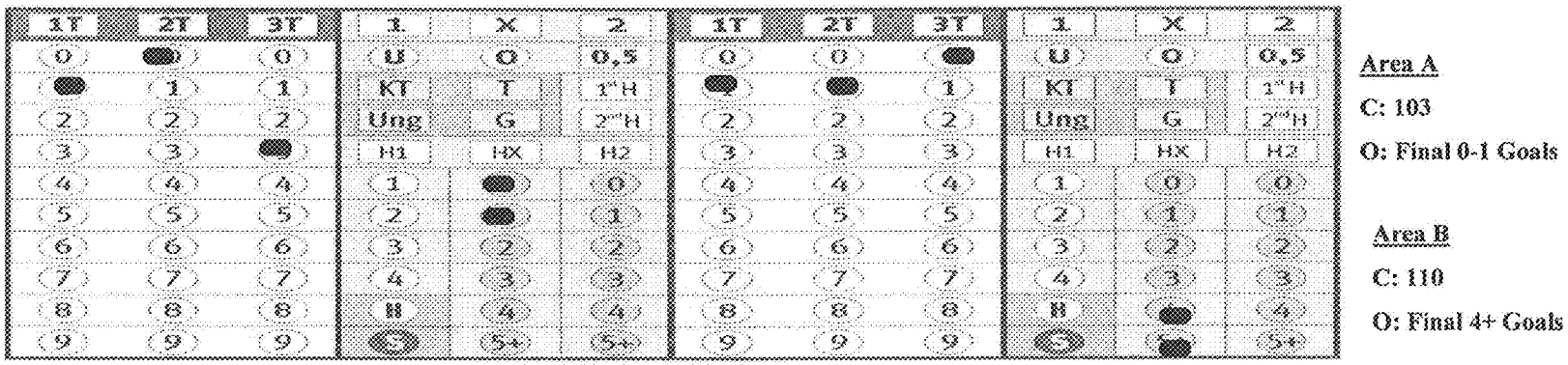
Figure 9Q:
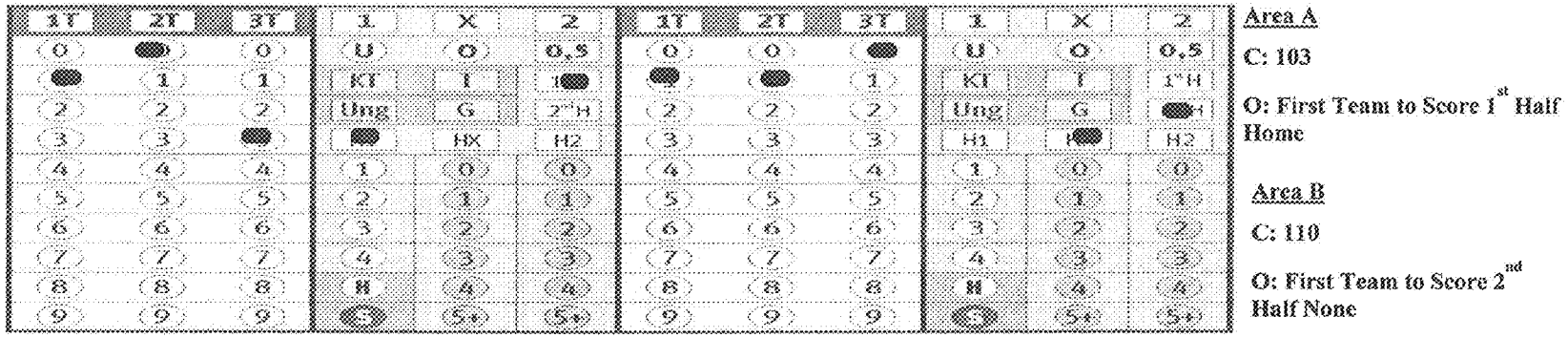
Figure 9R:
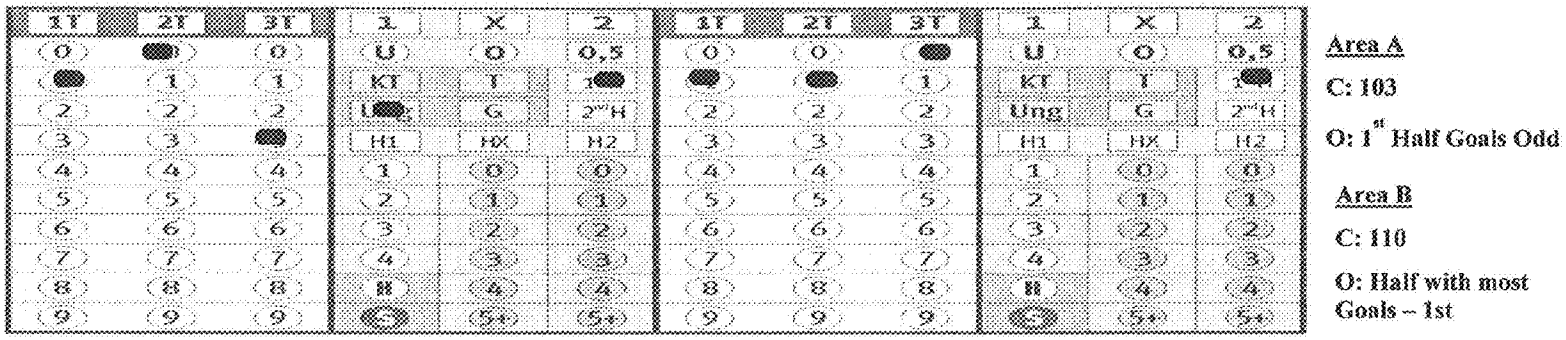
Figure 9S:
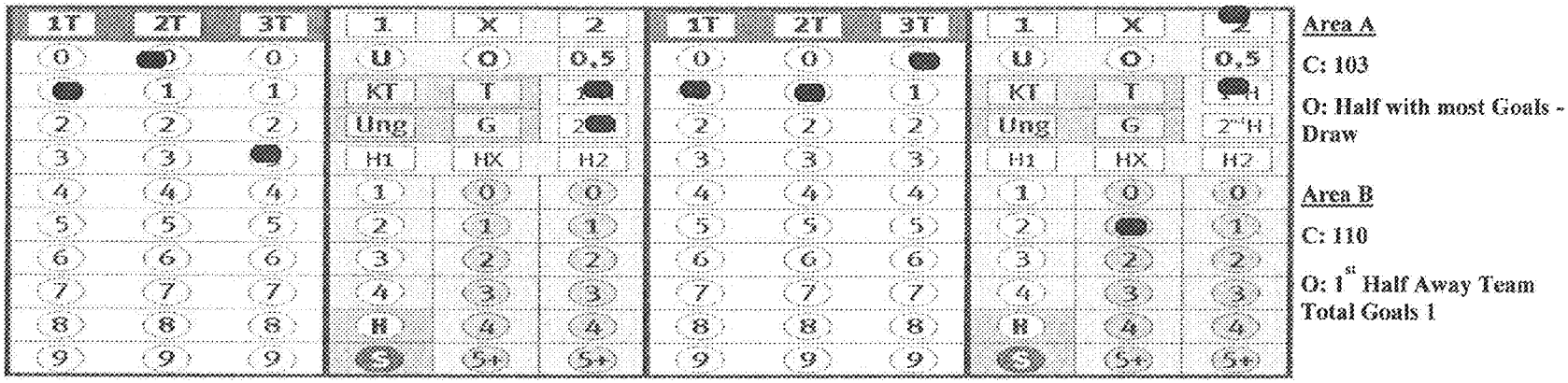
Figure 9T:
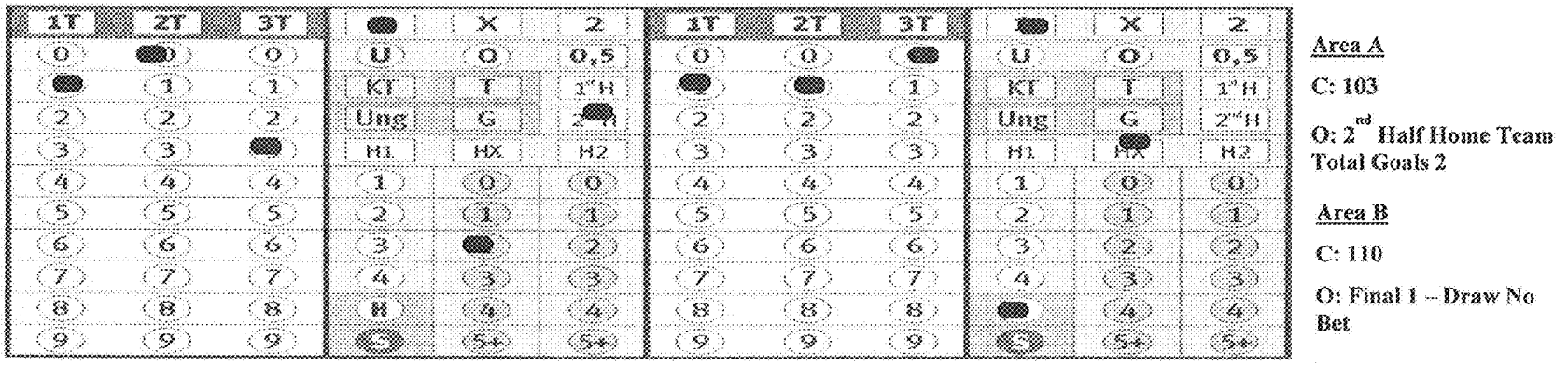
Figure 10A:
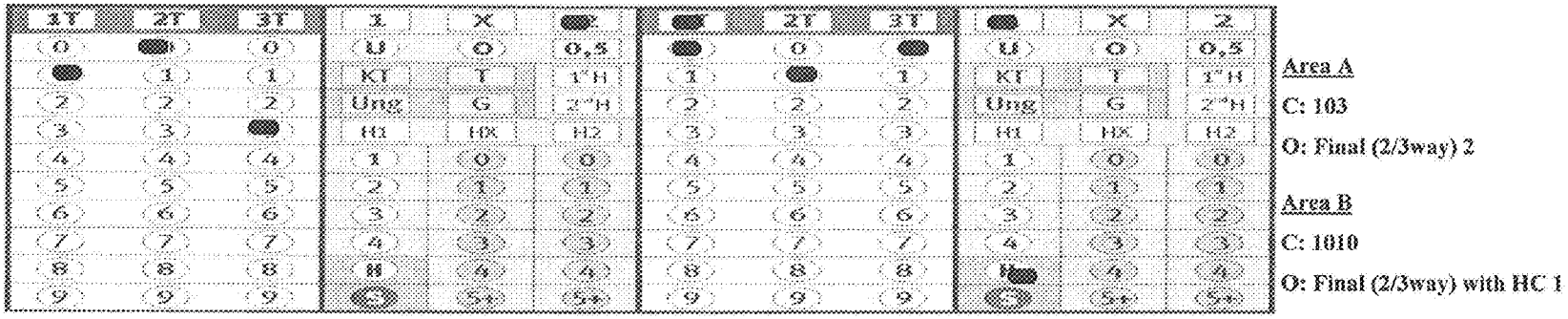
FIGS. 10A-10F are screenshots that illustrate examples of game/lottery slips in accordance with some embodiments of the present invention.
Figure 10B:
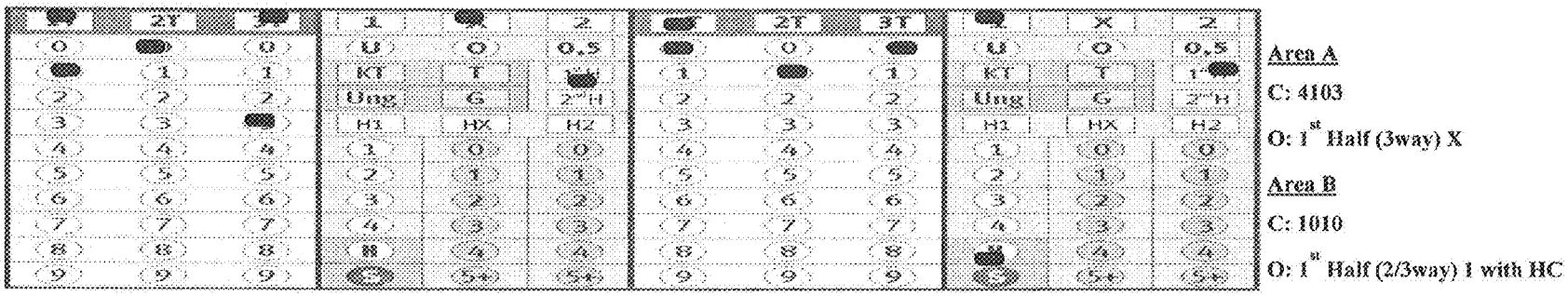
Figure 10C:
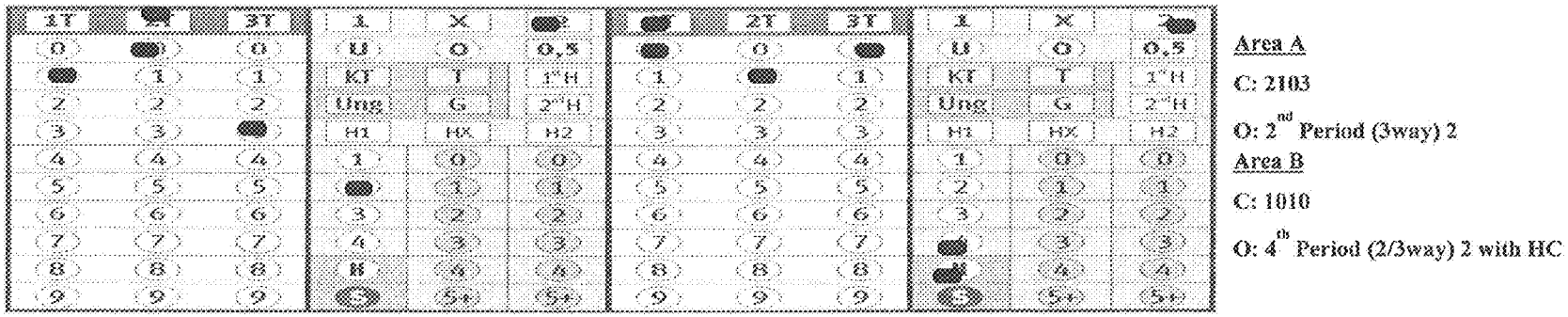
Figure 10D:
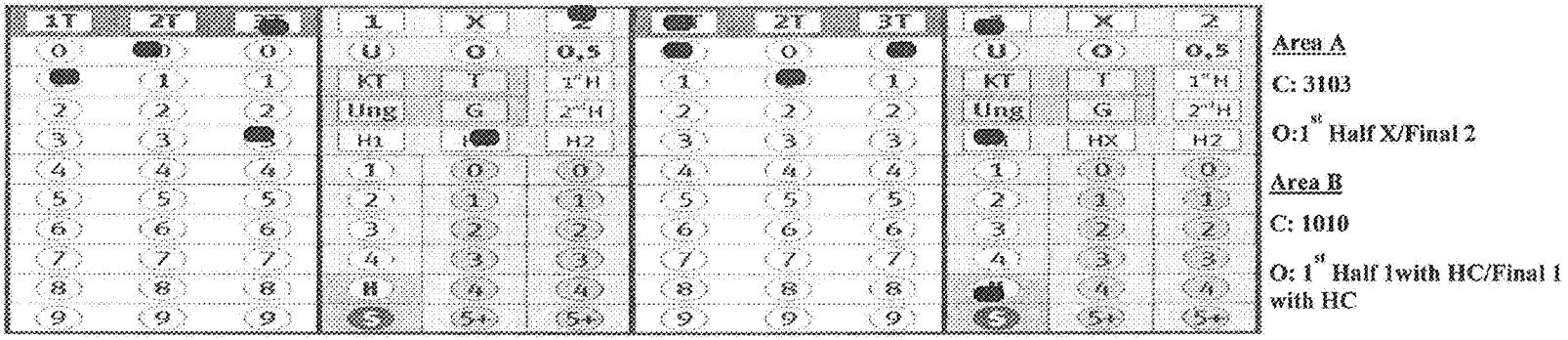
Figure 10E:
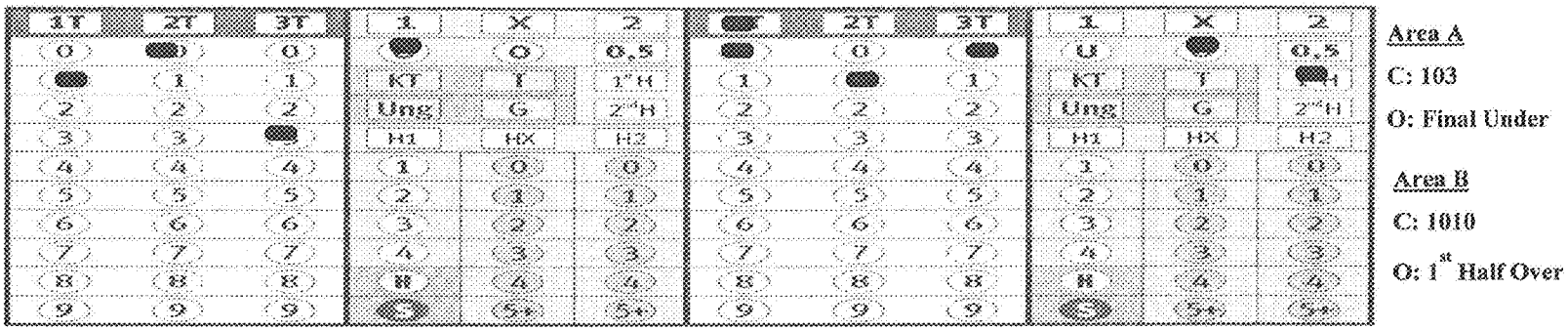
Figure 10F:
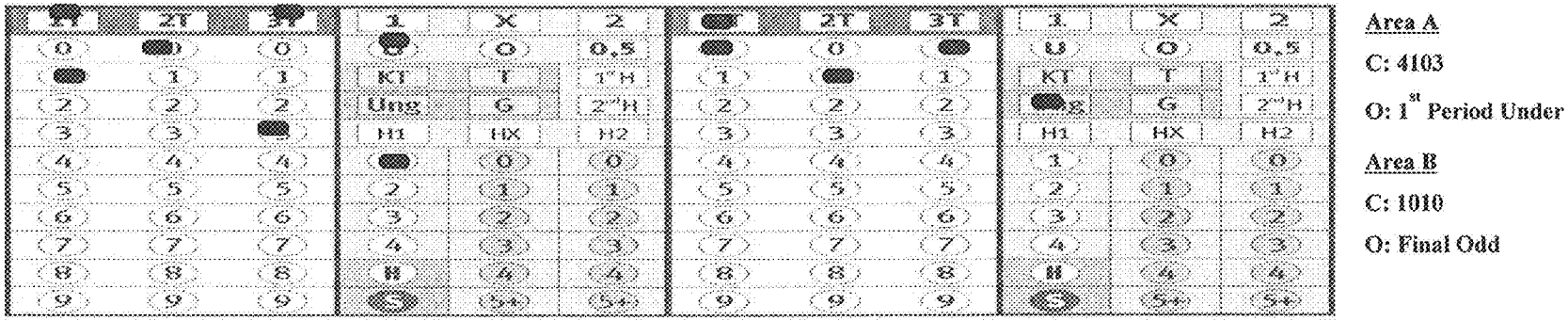
Figure 11A:
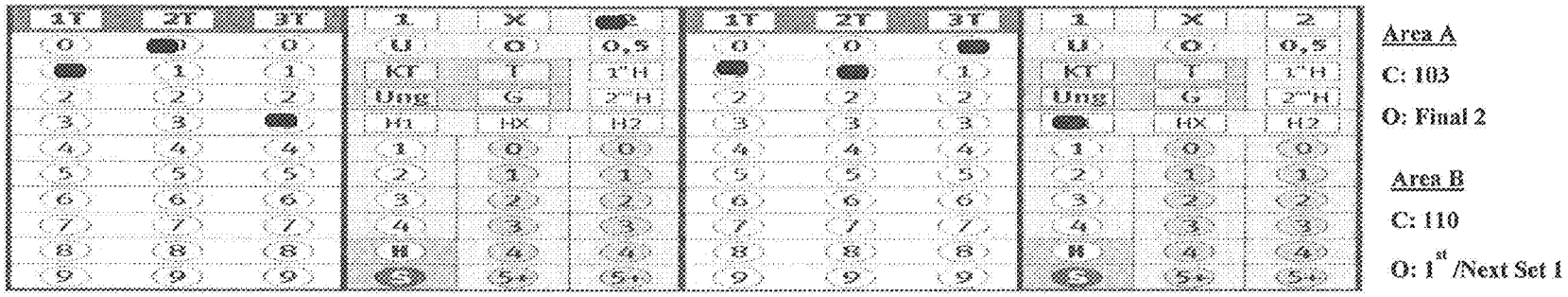
FIGS. 11A-11D are screenshots that illustrate examples of game/lottery slips in accordance with some embodiments of the present invention.
Figure 11B:
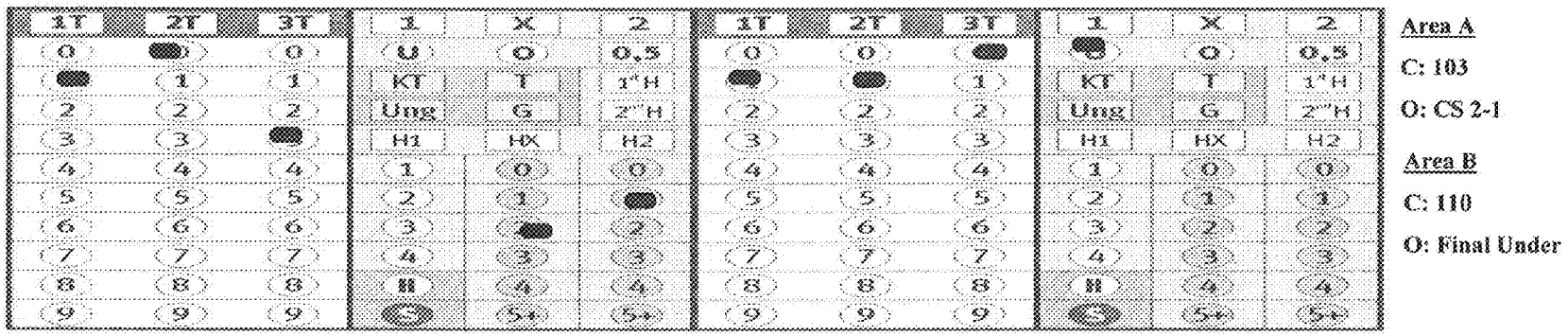
Figure 11C:
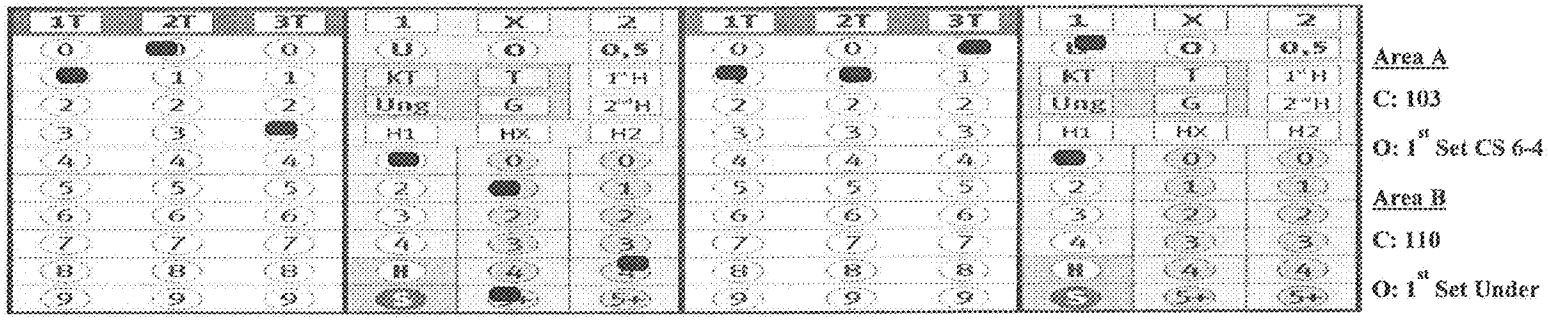
Figure 11D:
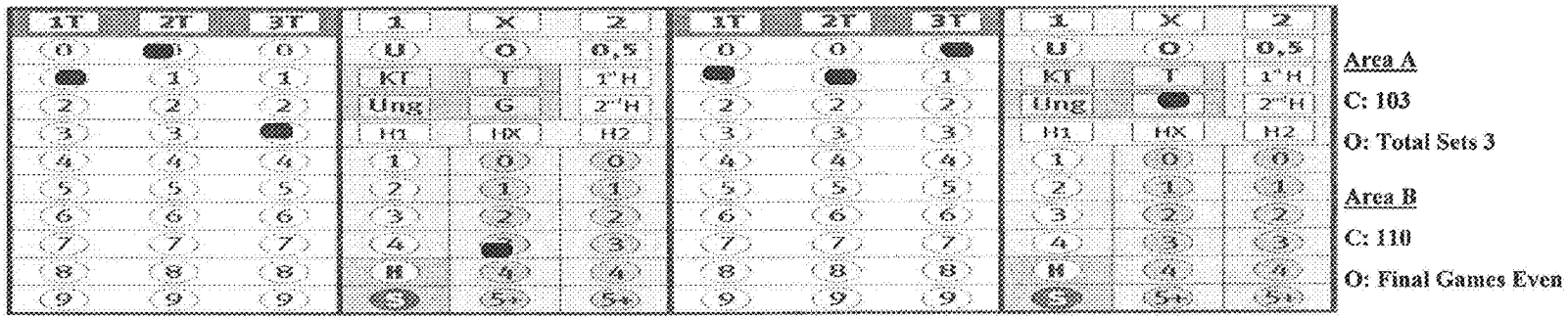

In some embodiments, FIGS. 9A-9T show examples of play slip markings for various markets and outcomes for soccer events.

In some embodiments, the instant invention can be applied to basketball sporting events with multiple markets and outcomes selected. Below are examples of various potential permutations that can be utilized for basketball events in some embodiments of the instant invention:

Final Result 2 way or 3 way
Halftime Result 3 way
Halftime/Fulltime Result
Period Result 3 way ($1^{st}$, $2^{nd}$, $3^{rd}$, $4^{th}$)
Final Result with Handicap 2 way or 3 way
Halftime Result with Handicap 2 way or 3 way
Halftime/Fulltime Result with Handicap
Period Result 2 way or 3 way with Handicap ($1^{st}$, $2^{nd}$, $3^{rd}$, $4^{th}$)
Under/Over points Final
Under/Over points Halftime
Under/Over points Period ($1^{st}$, $2^{nd}$, $3^{rd}$, $4^{th}$)
Odd/Even points Final.

In some embodiments, FIGS. 10A-10F show examples of play slip markings for various markets and outcomes for basketball events.

In some embodiments, the instant invention can be applied to tennis sporting events with multiple markets and outcomes selected. Below are examples of various potential permutations that can be utilized for tennis events in some embodiments of the instant invention:

Final Result
1st/Next Set Winner
Set Betting/Correct Score in Sets
Correct Score of a Set games
Total Number of Sets
Total Number of Games Odd/Even
Under/Over Total Number of Games
Under/Over Number of Games of a Set.

FIGS. 11A-11D show examples of play slip markings for various markets and outcomes for tennis events.

Figure 12A:
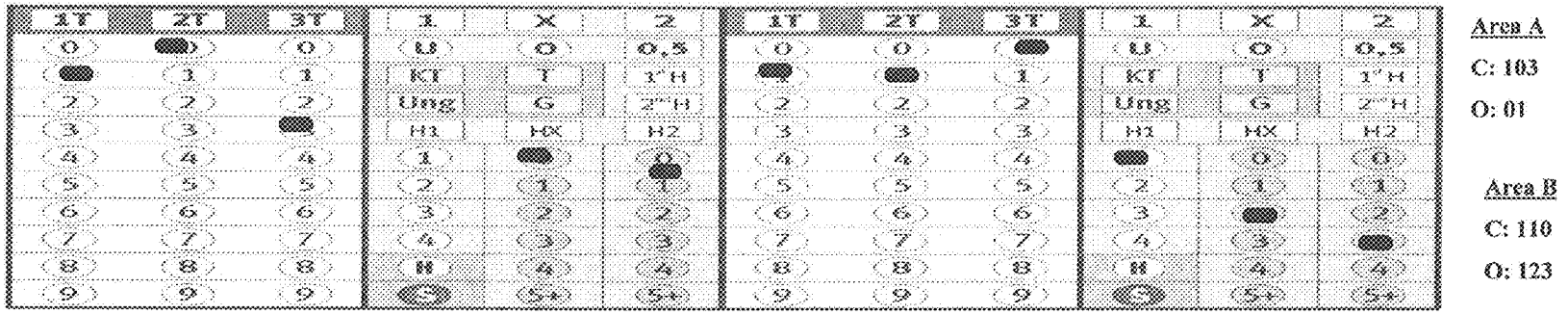
FIGS. 12A-12B are screenshots that illustrate examples of game/lottery slips in accordance with some embodiments of the present invention.
Figure 12B:
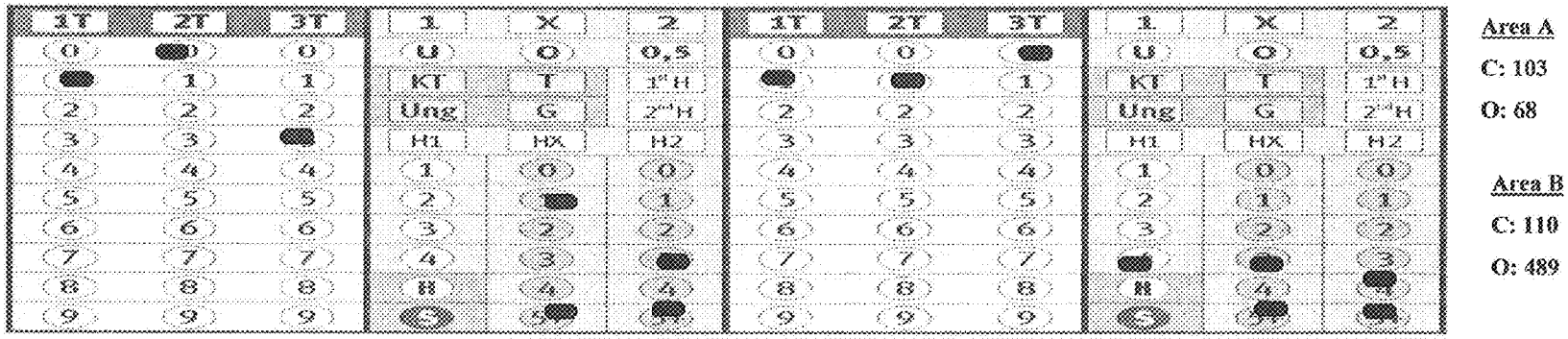

FIGS. 12A-12B show additional examples of play slip markings for various markets and outcomes for subsets of football, basketball, and/or tennis.

In some embodiments, the instant invention provides for a computer-implemented method that that includes at least the following steps of: displaying, by a specifically programmed computer system, to a user, choices to be selected to define at least one first personalized betting game, where the choices are selected from each of the following three categories: i) events, ii) markets, and iii) potential outcomes; receiving, by the specifically programmed computer system, from the user, selected choices, identifying: i) at least one first event, ii) a plurality of markets, and iii) a plurality of potential outcomes; establishing, by the specifically programmed computer system, at least one first personalized data structure representative of data relationships among the selected choices, hereby resulting in at least one first personalized betting game of the user; automatically updating, by the specifically programmed computer system, the at least one first personalized data structure based, at least in part, on real-time changes related to: i) the at least one first event, ii) the plurality of markets, and iii) the plurality of potential outcomes; receiving, by the specifically programmed computer system, an entry payment from the user to play the at least one first personalized betting game; determining, by the specifically programmed computer system, at least one actual outcome of the at least one first personalized betting game; and determining, by the specifically programmed computer system, at least one reward to be distributed to the user.

In some embodiments, the user is a lottery player. In some embodiments, the user is an organizer of the betting game. In some embodiments, the at least one first personalized betting game is a personalized lottery. In some embodiments, the choices to be selected by the user are displayed based, at least in part, on one of the following: i) a geographic location of the user, and ii) a channel used by the user to access the specifically programmed computer system.

In some embodiments, the method can further include automatically updating, by the specifically programmed computer system, the choices to be selected by the user. In some embodiments, the method can further include automatically completing, by the specifically programmed computer system, the at least one first personalized betting game for playing, by incorporating playing options into the at least one first personalized betting game based, at least in part, on the selected choices.

In some embodiments, the playing options are selected based, at least in part, at least one pre-determined template for the betting game. In some embodiments, the at least one pre-determined template defines at least the following playing options selected from the group of: i) an event selection, ii) an instant information update, iii) a loyalty scheme, iv) a risk management analysis, and v) a responsible gaming parameterization.

In some embodiments, the at least one first personalized betting game is configured to be identically played at a physical lottery establishment and remotely through at least one computing device. In some embodiments, the at least one computing device is a mobile personal computing device.

In some embodiments, the least one first personalized betting game is configured to be played by a group of member players solicited by or on behalf of the user.

In some embodiments, the least one first even is selected from the group of: i) a soccer game; ii) a basketball game; and iii) a tennis game.

In some embodiments, the instant invention provides for a computer-implemented system that includes at least the following components/modules: at least one specialize computer machine that at least includes: a non-transient memory having at least one region for storing particular computer executable program code; and at least one processor for executing the particular program code stored in the memory, where the particular program code is configured to at least perform the following operations: displaying, to a user, choices to be selected to define at least one first personalized betting game, where the choices are selected from each of the following three categories: i) events, ii) markets, and iii) potential outcomes; receiving, by the specifically programmed computer system, from the user, selected choices, identifying: i) at least one first event, ii) a plurality of markets, and iii) a plurality of potential outcomes; establishing at least one first personalized data structure representative of data relationships among the selected choices, hereby resulting in at least one first personalized betting game of the user; automatically updating the at least one first personalized data structure based, at least in part, on real-time changes related to: i) the at least one first event, ii) the plurality of markets, and iii) the plurality of potential outcomes; receiving an entry payment from the user to play the at least one first personalized betting game; determining at least one actual outcome of the at least one first personalized betting game; and determining at least one reward to be distributed to the user.

While a number of embodiments of the present invention have been described, it is understood that these embodiments are illustrative only, and not restrictive, and that many modifications may become apparent to those of ordinary skill in the art. Further still, the various steps may be carried out in any desired order (and any desired steps may be added and/or any desired steps may be eliminated).

What is claimed is:

1. A computer-implemented method, comprising:

displaying, in real time, by a specifically programmed game-operating computer system, to a user, via a computing device being utilized by the user, a paper print-out, or any combination thereof, choices to be selected to define at least one first personalized betting game, wherein the choices are selected from each of the following three categories:

i) events, ii) markets, and iii) potential outcomes;

electronically receiving, in real time, by the specifically programmed game-operating computer system, from the user, via the computing device being utilized by the user, the paper print-out, or any combination thereof, selected choices, identifying:

i) at least one first event,
ii) a plurality of markets, and
iii) a plurality of potential outcomes;
establishing, in real time, by the specifically programmed game-operating computer system, at least one first personalized data structure representative of data relationships among the selected choices, hereby resulting in at least one first personalized betting game of the user;
automatically updating, in real time, by the specifically programmed game-operating computer system, the at least one first personalized data structure based, at least in part, on real-time changes related to:
i) the at least one first event,
ii) the plurality of markets, and
iii) the plurality of potential outcomes;
electronically receiving, in real time, by the specifically programmed game-operating computer system, via the computing device being utilized by the user, an entry payment from the user to play the at least one first personalized betting game;
determining, in real time, by the specifically programmed game-operating computer system, at least one actual outcome of the at least one first personalized betting game; and
determining, in real time, by the specifically programmed game-operating computer system, at least one reward to be distributed to the user.

2. The method of claim 1, wherein the user is a lottery player.

3. The method of claim 1, wherein the user is an organizer of the betting game.

4. The method of claim 1, wherein the at least one first personalized betting game is a personalized lottery.

5. The method of claim 1, wherein the choices to be selected by the user are displayed based, at least in part, on one of the following:
i) a geographic location of the user, and
ii) a channel used by the user to access the specifically programmed game-operating computer system.

6. The method of claim 1, wherein the method further comprises,
automatically updating, in real time, by the specifically programmed game-operating computer system, the choices to be selected by the user.

7. The method of claim 1, wherein the method further comprises:
automatically completing, in real time, by the specifically programmed game-operating computer system, the at least one first personalized betting game for playing, by incorporating playing options into the at least one first personalized betting game based, at least in part, on the selected choices.

8. The method of claim 7, wherein the playing options are selected based, at least in part, at least one pre-determined template for the betting game.

9. The method of claim 8, wherein the at least one pre-determined template defines at least the following playing options selected from the group of:
i) an event selection,
ii) an instant information update,
iii) a loyalty scheme,
iv) a risk management analysis, and
v) a responsible gaming parameterization.

10. The method of claim 1, wherein the at least one first personalized betting game is configured to be identically played at a physical lottery establishment and remotely through at least one computing device.

11. The method of claim 10, wherein the at least one computing device is a mobile personal computing device.

12. The method of claim 1, wherein the least one first personalized betting game is configured to be played by a group of member players solicited by or on behalf of the user.

13. The method of claim 1, wherein the least one first event is selected from the group of:
i) a soccer game;
ii) a basketball game; and
iii) a tennis game.

14. A computer system, comprising:
at least one specialized game-operating computer machine, comprising:
a non-transient memory having at least one region for storing particular computer executable game-operating program code; and
at least one processor for executing the particular game-operating program code stored in the memory, wherein the particular game-operating program code is configured to at least perform the following operations:
displaying, in real time, via a computing device being utilized by the user, a paper print-out, or any combination thereof, to a user, choices to be selected to define at least one first personalized betting game, wherein the choices are selected from each of the following three categories:
i) events,
ii) markets, and
iii) potential outcomes;
electronically receiving, in real time, from the user, via the computing device being utilized by the user, the paper print-out, or any combination thereof, selected choices, identifying:
i) at least one first event,
ii) a plurality of markets, and
iii) a plurality of potential outcomes;
establishing, in real time, at least one first personalized data structure representative of data relationships among the selected choices, hereby resulting in at least one first personalized betting game of the user;
automatically updating, in real time, the at least one first personalized data structure based, at least in part, on real-time changes related to:
i) the at least one first event,
ii) the plurality of markets, and
iii) the plurality of potential outcomes;
electronically receiving, in real time, an entry payment from the user to play the at least one first personalized betting game;
determining, in real time, at least one actual outcome of the at least one first personalized betting game; and
determining, in real time, at least one reward to be distributed to the user.

15. The system of claim 14, wherein the user is a lottery player.

16. The system of claim 14, wherein the user is an organizer of the betting game.

17. The system of claim 14, wherein the at least one first personalized betting game is a personalized lottery.

18. The system of claim 14, wherein the choices to be selected by the user are displayed based, at least in part, on one of the following:
i) a geographic location of the user, and
ii) a channel used by the user to access the specifically programmed game-operating computer system.

19. The system of claim 14, wherein the selected choices are selected based, at least in part, at least one pre-determined template for a betting game.

20. The system of claim 19, wherein the at least one pre-determined template defines at least the following playing options selected from the group of:

i) an event selection, ii) an instant information update, iii) a loyalty scheme, iv) a risk management analysis, and v) a responsible gaming parameterization.

21. The system of claim 14, wherein the at least one first personalized betting game is configured to be identically played at a physical lottery establishment and remotely through at least one computing device.

22. The system of claim 21, wherein the at least one computing device is a mobile personal computing device.

23. The system of claim 14, wherein the least one first event is selected from the group of:

i) a soccer game;

ii) a basketball game; and iii) a tennis game.

* * * * *